US005883961A

United States Patent [19]

House et al.

[11] Patent Number: 5,883,961

[45] Date of Patent: Mar. 16, 1999

[54] SOUND SYSTEM

[75] Inventors: William Neal House, Bloomington; Roger E. Shively, Greenwood, both of Ind.

[73] Assignee: Harman International Industries, Incorporated, Northridge, Calif.

[21] Appl. No.: 809,211

[22] PCT Filed: Jan. 24, 1997

[86] PCT No.: PCT/US97/01054

§ 371 Date: Mar. 17, 1997

§ 102(e) Date: Mar. 17, 1997

[87] PCT Pub. No.: WO97/27724

PCT Pub. Date: Jul. 31, 1997

Related U.S. Application Data

[60] Provisional application No. 60/010,629 Jan. 26, 1996.

[51] Int. Cl.[6] ..... H04R 5/00

[52] U.S. Cl. ..... 381/1; 381/26

[58] Field of Search ..... 381/1, 2, 26, 309, 381/103

[56] References Cited

U.S. PATENT DOCUMENTS

| | | |
|---|---|---|
| 4,132,859 | 1/1979 | Ranga . |
| 4,329,544 | 5/1982 | Yamada . |
| 4,594,729 | 6/1986 | Weingartner . |
| 4,703,502 | 10/1987 | Kasai et al. . |
| 4,769,843 | 9/1988 | Imai et al. . |
| 4,893,342 | 1/1990 | Cooper et al. . |
| 4,910,779 | 3/1990 | Cooper et al. . |
| 4,924,962 | 5/1990 | Terai et al. . |
| 4,953,213 | 8/1990 | Tasaki et al. . |
| 4,953,219 | 8/1990 | Kasai et al. . |
| 4,968,154 | 11/1990 | Baeg . |
| 4,972,489 | 11/1990 | Oki et al. . |
| 4,975,954 | 12/1990 | Cooper et al. . |
| 5,034,983 | 7/1991 | Cooper et al. . |
| 5,129,004 | 7/1992 | Imai et al. . |
| 5,136,651 | 8/1992 | Cooper et al. . |
| 5,155,770 | 10/1992 | Maejima . |
| 5,172,415 | 12/1992 | Fosgate . |
| 5,333,200 | 7/1994 | Cooper et al. . |
| 5,754,664 | 5/1998 | Clark et al. . |

OTHER PUBLICATIONS

Motorola, Digital Signal Processor User's Manual, DSP56004, 1993, 210 pages.

Motorola Semiconductor Technical Data, Symphony™ Audio DSP Family 24–Bit Digital Signal Processors, DSP56004, DSP56007, 1995, pp. 1–88.

*Primary Examiner*—Vivian Chang
*Attorney, Agent, or Firm*—Barnes & Thornburg

[57] ABSTRACT

A method of synthesizing a set of filters comprises locating first and second loudspeakers at first and second locations, respectively, coupling a first component of an audio program to the first loudspeaker to be reproduced thereby, and coupling a second component of the audio program to the second loudspeaker to be reproduced thereby. First and second microphones are placed at third and fourth locations, respectively, at which the reproduced first and second audio components are to be heard in order to convert audio impinging upon the first and second microphones into first and second microphone signals, respectively. A first set of transfer functions is developed from the first and second components of the audio program and the first and second microphone signals. One loudspeaker is then located at a fifth location different from one of the first and second locations. The first component is then coupled to the first loudspeaker, and the second component to the second loudspeaker. Third and fourth microphone signals are developed from the first and second components impinging on the first and second microphones, respectively. A second set of transfer functions is developed from the first and second components and the third and fourth microphone signals, respectively. The set of filters is synthesized from the first and second sets of transfer functions.

27 Claims, 36 Drawing Sheets

SOUND SYSTEM

CROSS REFERENCES TO RELATED APPLICATIONS

This application is a U.S. national phase counterpart of international application serial No. PCT/US97/01054 filed Jan. 24, 1997 which claims priority to U.S. provisional application Ser. No. 60/010,629 filed Jan. 26, 1996.

TECHNICAL FIELD OF THE INVENTION

This invention relates to spatial enhancement in multiple source, for example, multiple loudspeaker, sound systems. It is disclosed in the context of a multiple loudspeaker automobile sound system, but is believed to be useful in other contexts as well.

BACKGROUND ART

The use of signal processing techniques to enhance the reproduction of sounds from multiple sound reproducers, for example, multiple loudspeakers, is well documented. There are, for example, the systems disclosed in U.S. Pat. Nos. 4,893,342; 4,910,779; 4,975,954; 5,034,983; 5,136,651; and, 5,333,200, and the references cited in these patents.

Referring, for example, to U.S. Pat. Nos. 4,975,954 and 5,333,200, the systems disclosed in these patents are capable of reducing crosstalk among multiple sound sources which project sound into a common environment. Such an environment exists inside of a listening room or an automotive vehicle passenger compartment served by multiple loudspeakers playing back, for example, different frequency components of a common program.

DISCLOSURE OF THE INVENTION

A method of synthesizing a set of filters comprises locating first and second loudspeakers at first and second locations, respectively, coupling a first component of an audio program to the first loudspeaker to be reproduced thereby, and coupling a second component of the audio program to the second loudspeaker to be reproduced thereby. First and second microphones are placed at third and fourth locations, respectively, at which the reproduced first and second audio components are to be heard in order to convert audio impinging upon the first and second microphones into first and second microphone signals, respectively. A first set of transfer functions is developed from the first and second components of the audio program and the first and second microphone signals. One of the first and second loudspeakers is located at a fifth location different from at least one of the first and second locations at which it is desired to create an image of the one of the first and second loudspeakers. The first component is coupled to the first loudspeaker to be reproduced thereby. The second component is coupled to the second loudspeaker to be reproduced thereby. Third and fourth microphone signals are developed from the first and second components impinging on the first and second microphones, respectively. A second set of transfer functions is developed from the first and second components and the third and fourth microphone signals, respectively. The set of filters is synthesized from the first and second sets of transfer functions.

Illustratively, locating the first and second loudspeakers at first and second locations, respectively, and placing first and second microphones at third and fourth locations, respectively, together comprise locating the first and second loudspeakers at first and second locations, respectively, which are non-symmetric with respect to the third and fourth locations, respectively.

Further illustratively, placing first and second microphones at third and fourth locations, respectively, comprises providing a dummy head and providing the first and second microphones at about the locations of the left and right pinnae, respectively, of the dummy head.

Additionally illustratively, locating one of the first and second loudspeakers at a fifth location comprises locating the first and second loudspeakers at fifth and sixth locations, respectively, at which it is desired to create images of the first and second loudspeakers, respectively. The fifth and sixth locations are different from both the first and second locations.

Additionally illustratively, the first transfer function is developed before the second transfer function.

Alternatively, illustratively, the second transfer function is developed before the first transfer function.

Further illustratively, locating first and second loudspeakers at first and second locations comprises locating first and second loudspeakers at first and second locations, respectively, within a vehicle passenger compartment.

Additionally illustratively, locating one of the first and second loudspeakers at a fifth location comprises locating the one of the first and second loudspeakers at a fifth location outside the vehicle passenger compartment.

According to another aspect of the invention, a second of filters is synthesized by the method.

According to yet another aspect of the invention, a sound reproduction system incorporates a set of filters synthesized by the method.

BRIEF DESCRIPTION OF THE DRAWINGS

The invention may best be understood by referring to the following detailed description and accompanying drawings which illustrate the invention. In the drawings:

FIGS. 1*a–b* illustrate in partly block diagram and partly fragmentary top plan view a system constructed according to the present invention;

FIGS. 4*a–b* illustrate a transfer function of a channel of a digital filter for a particular make and model of automobile according to the invention;

MODES FOR CARRYING OUT THE INVENTION

Figure 1A:
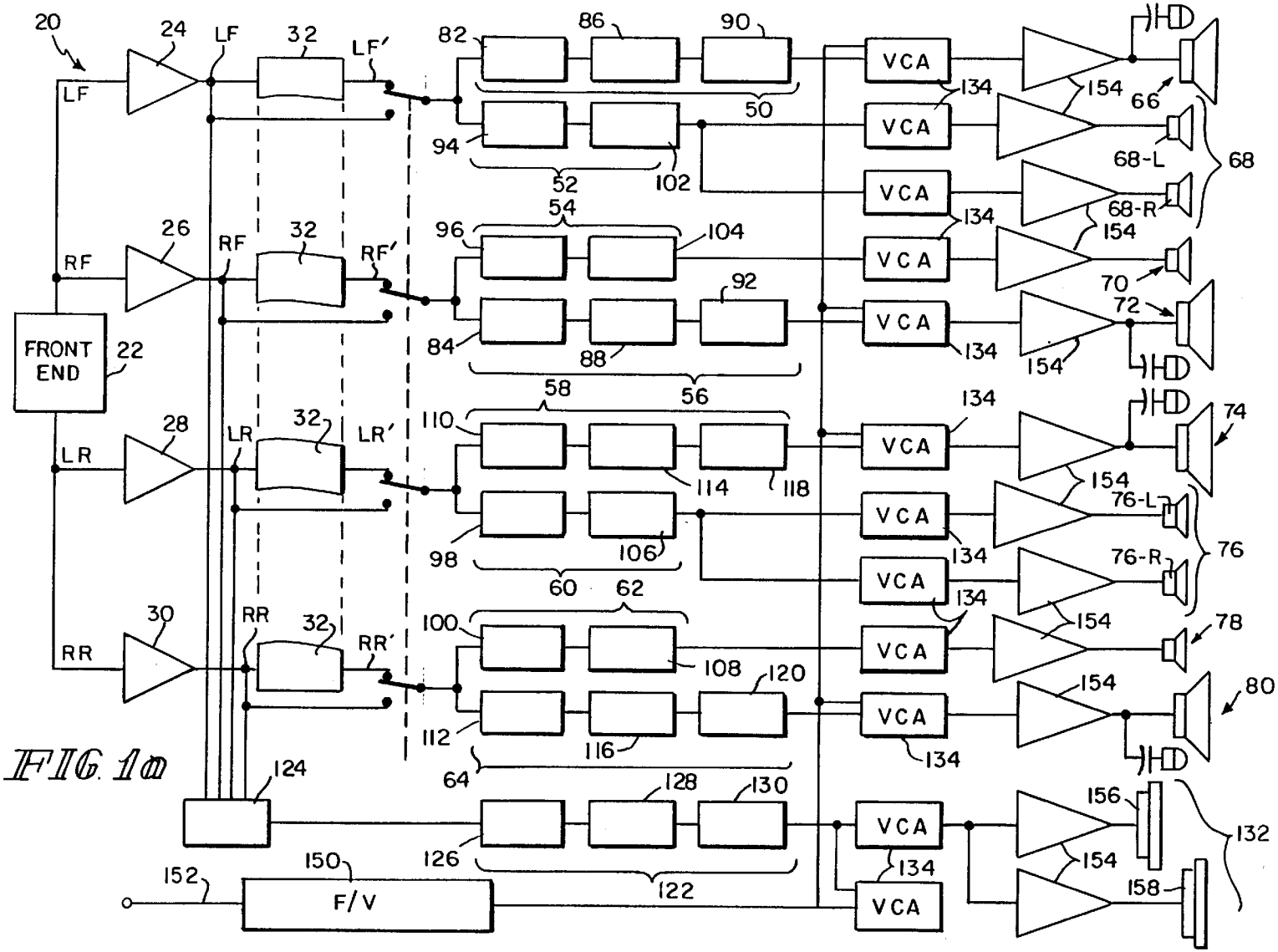

Referring now particularly to FIGS. 1*a–b*, an automotive sound system 20 accepts the four conventional output signals left front (lf), right front (rf), left rear (lr) and right rear (rr) from an automobile head end 22, which is typically mounted behind a vehicle 21's dashboard 23. These four signals are separately amplified by buffer amplifiers 24, 26, 28, 30, respectively, of conventional configuration. The buffered output signals LF, RF, LR, RR are coupled to four input ports of a digital signal processor (DSP) 32 which illustratively is a Motorola 56004 four channel DSP 32. DSP 32 can for purposes of this discussion be thought of as a collection of digital filters. The functions of these digital filters are to combine and equalize the four channels LF, RF, LR, RR in such ways as to compensate for the head related transfer functions (HRTFs) of four hypothetical passengers sitting in the driver's seat (D), front seat passenger's seat (FS), left rear passenger's seat (LRS) and right rear passenger's seat (RRS), and for the actual locations of the speakers of the sound system 20. Speaker images are formed by the digital filters of DSP 32 at more ideal locations for the listener(s) at one or more of locations D, FS, LRS, RRS.

This combination and equalization is achieved in such a way that, with the speaker complement of the particular make and model of vehicle, the DSP 32 creates an image of a "left" speaker, for example, 30° left and one foot forward of each left seat hypothetical passenger's left ear, 30° right and one foot forward of each right seat hypothetical passenger's right ear, and a "right" speaker 30° right and one foot forward of each left seat hypothetical passenger's right ear and 30° left and one foot forward of each right seat hypothetical passenger's left ear. The angles 30° and distance one foot are employed for purposes of illustration only, and are not intended in any way to limit the claims. The transfer functions of the DSP 32 filters could equally as readily provide speaker angles of 20° or 45° or some other suitable angles and distances of six inches or two feet or some other suitable distances with appropriate modeling. It should also be understood that the image speaker locations need not even be inside the vehicle if placement of the speakers to model the image speaker locations does not interfere with the signal path from the image speaker location to the dummy head(s) which is (are) being used to generate the image speaker locations' transfer functions. The distances and angles need not even be the same for the left and right image speakers for a particular passenger D, FS, LRS, RRS. However for binaural audio, equal angles and distances are conventional.

The term "hypothetical passenger" is used here to emphasize that the way in which the filters in DSP 32 are synthesized is by modeling using (a) dummy head(s) in the particular make and model of vehicle 21 for which the system 20 is being designed. The dummy head(s) is (are) placed at the elevation and in the location the or each passenger, D, FS, LRS and RRS, would occupy in the vehicle 21, and a first transfer function is established from the vehicle sound system 20 for the dummy head(s) at that (those) position(s). Then speakers are placed at the actual locations where it is desired to create the two (L and R) binaural speakers' images for each passenger D, FS, LRS and RRS, and a second transfer function is established for the dummy head at that location with the L and R speakers in their desired or "image" locations. A filter which will realize the second transfer function from the first transfer function is then synthesized, using, for example, digital signal processing analogs of the analog signal processing techniques described in, for example, U.S. Pat. Nos. 4,975,954 and 5,333,200. The algorithm for realizing that filter digitally is then programmed into that one channel coupled between that one of the four input ports LF, RF, LR, RR and that one of the four output ports LF', RF', LR', RR' of DSP 32. The four output ports LF', RF', LR', RR' are then coupled through separate equalization and filtering channels 50, 52, 54, 56, 58, 60, 62 and 64 to separate suites 66, 68, 70, 72, 74, 76, 78 and 80 respectively, of speakers which reproduce the program material provided to them.

Channels 50 and 56 each contain a six-pole equalizer 82, 84, respectively, a high pass filter 86, 88, respectively, and a low pass filter 90, 92, respectively, in cascade. The corner frequencies of filters 86, 88 illustratively can be 20 Hz. The corner frequencies of filters 90, 92 illustratively can be 20 KHz. The poles of equalizers 82, 84 are selected for the particular listening environment of a particular location D, FS, LRS, RRS in a particular make and model of vehicle. These permit distracting, unpleasant, or otherwise undesirable artifacts to be equalized out of the signals supplied to suites 66 and 72, respectively, of speakers.

Channels 52, 54, 60 and 62 each contain a four-pole equalizer 94, 96, 98 and 100, respectively, and a high pass filter 102, 104, 106 and 108 respectively, in cascade, The corner frequencies of filters 102, 104, 106 and 108 illustratively can be 400 Hz. The poles of equalizers 94, 96, 98 and 100 again are selected for the particular listening environment of a particular location D, FS, LRS, RRS in the particular make and model of vehicle for which system 20 is designed. Again, these permit undesirable artifacts of the operation of system 20 to be equalized out of the signals supplied to suites 68, 70, 76 and 78, respectively, of speakers.

Channels 58 and 64 each contain a four pole equalizer 110, 112, respectively, a high pass filter 114, 116, respectively, and a low pass filter 118, 120, respectively, in cascade. The corner frequencies of filters 114, 116 illustratively can be 50 Hz. The corner frequencies of filters 118, 120 illustratively can be 400 Hz. The poles of equalizers 110, 112 also are selected for the particular listening environment of a particular location D, FS, LRS, RRS in the particular make and model of vehicle. These permit undesirable artifacts to be equalized out of the signals supplied to suites 74 and 80, respectively, of speakers.

An additional channel 122 is formed from the sum of the signals LF, RF, LR, RR at the output terminals of buffer amplifiers 24, 26, 28, 30, respectively. This channel 122 includes a summing circuit 124 for summing these signals, a four-pole equalizer 126, high pass filter 128 and low pass filter 130 in cascade. The corner frequency of filter 128 illustratively can be 20 Hz. The corner frequency of filter 130 illustratively can be 300 Hz. The poles of equalizer 126 are selected for the particular listening environment of a particular make and model of vehicle. These permit undesirable artifacts to be equalized out of the signals supplied to a suite 132 of speakers.

Each channel 50, 52, 54, 56, 58, 60, 62, 64 and 122 includes a voltage controlled amplifier (VCA) 134. The control voltage inputs of all of VCAs 134 are coupled to an output port of a frequency-to-voltage converter 150, an input port of which is coupled to a vehicle speed-to-frequency line 152 of the vehicle electrical bus. Many vehicles are provided with such a line. This line, when provided, carries pulses at a rate proportional to, for example, vehicle speed. It may be supplied to, and available at, for example, the vehicle speedometer input.

Each channel 50, 52, 54, 56, 58, 60, 62 and 64 also includes one or more basic power amplifiers 154, each of which has a rated output power of, for example, 40 W, into its load. Among the amplifier 154 loads, suite 132 of speakers includes two, for example, 20 cm diameter subwoofers 156, 158, one mounted in each of the rear doors of the vehicle. Each of these subwoofers 156, 158 is supplied by its own power amplifier 154.

Illustratively, each of speaker suites 66, 72, 74 and 80 includes a 14 cm or 15 cm diameter midwoofer having a 2Ω voice coil and a 6Ω voice coil with the front speakers (those of suites 66 and 72) mounted in the left and right front kick panels, respectively, and the rear speakers (those of suites 74 and 80) mounted in the left and right rear doors, respectively. Each of speaker suites 66, 72, 74 and 80 also illustratively includes a 25 mm dome tweeter mounted in the left front, right front, left rear and right rear door, respectively.

Illustratively, each of speaker suites 68 and 76 comprises a pair 68-L and 68-R, and 76-L and 76-R, respectively, of 6.5 cm diameter midrange/tweeter speakers mounted in the left and right front headliner (68-L and 68-R, respectively) and the left and right rear headliner (76-L and 76-R, respectively).

Illustratively, each of speaker suites 70,78 comprises a 6.5 cm diameter midrange/tweeter speaker mounted in the center front headliner and the center rear headliner, respectively.

The system 20 may be equipped with a dashboard 23-mounted switch control 160 which permits the DSP 32 to be bypassed, should the vehicle 21 operator D wish to do so.

While DSP filtering techniques are employed in this embodiment, it should be understood that systems constructed according to the invention can be realized using analog synthesis techniques as well. Additionally, while three headliner speakers are employed in the illustrated embodiment, it should be understood that a single headliner speaker in the position of, for example, speakers 70 and 78 can carry the RF' and RR' signals, respectively, with the LF' and LR' signals being carried by speakers in the positions of, for example, speakers 66, 72 and 74, 80, 156, 158. Alternatively, each of speakers 70, 78 could be split into two separate speakers, one directed more toward the driver or left side passenger and one directed more the right side passenger for a total complement of eight speakers in the headliner (four across the front and four across the rear).

It should further be appreciated that, because image speaker locations are modeled by placing speakers at these locations and playing program material through them into the vehicle interior, vehicle interior reflections and other undesirable artifacts are inherently compensated to a great extent by the DSP 32 filter algorithms. Separate compensation for these artifacts may not even be necessary in certain applications. It may be noted that not all speaker suites 66, 68, 72, 74, 76, 78, 80 and 132 are supplied all of the 3-D audio cues in the illustrated embodiment. For example, different frequency ranges are provided to different suites of speakers. Rather, these suites of speakers are provided sufficient cues to extend the bandwidth, enhance spatial cues and create a 360° sound stage. However, it should be readily apparent that all speakers could, through an extension of the techniques taught by this application, be supplied with all of the 3-D cues for speaker imaging at all frequencies.

Figure 2A:
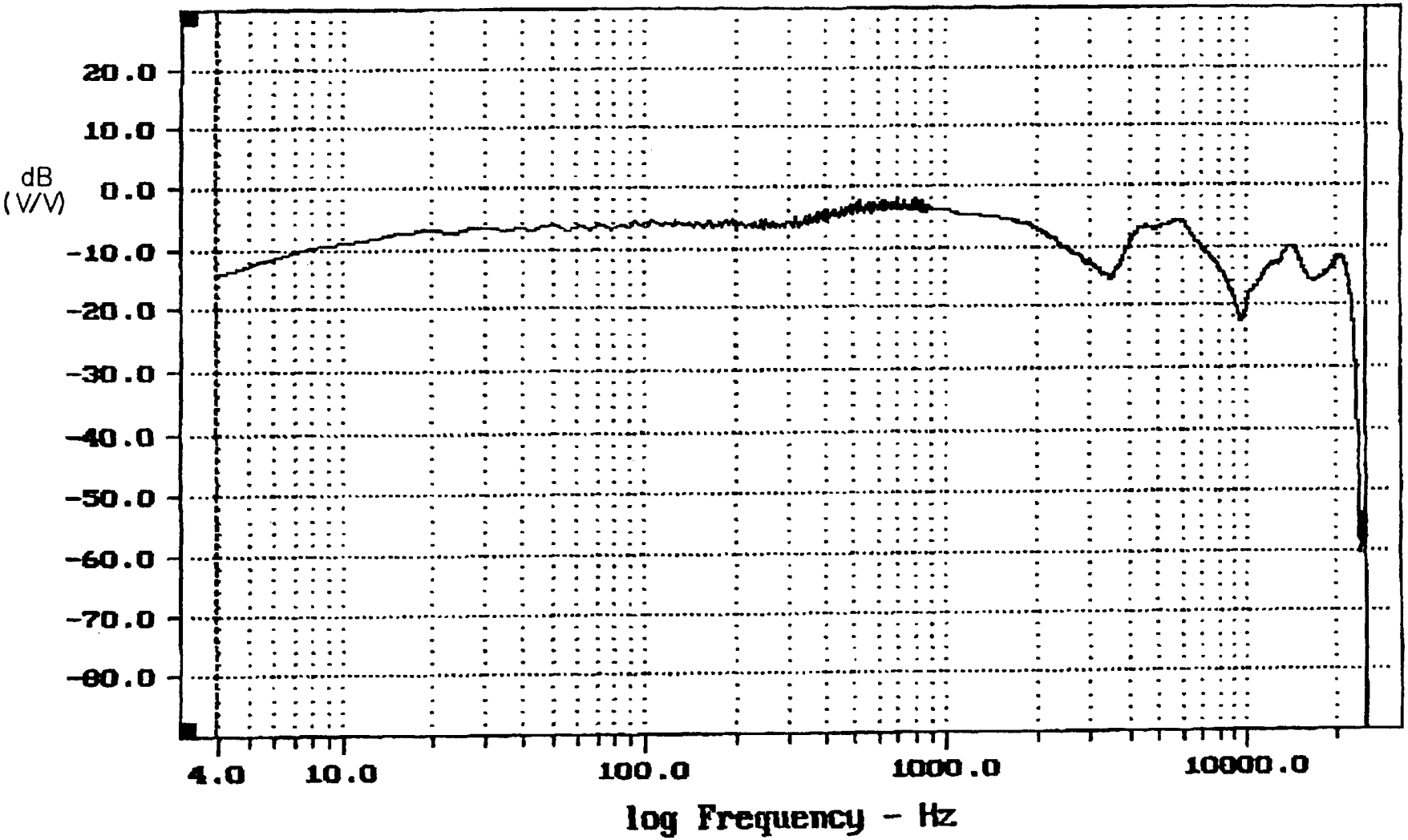
FIGS. 2*a–b* illustrate a transfer function of a channel of a digital filter for a particular make and model of automobile according to the invention.
Figure 2B:
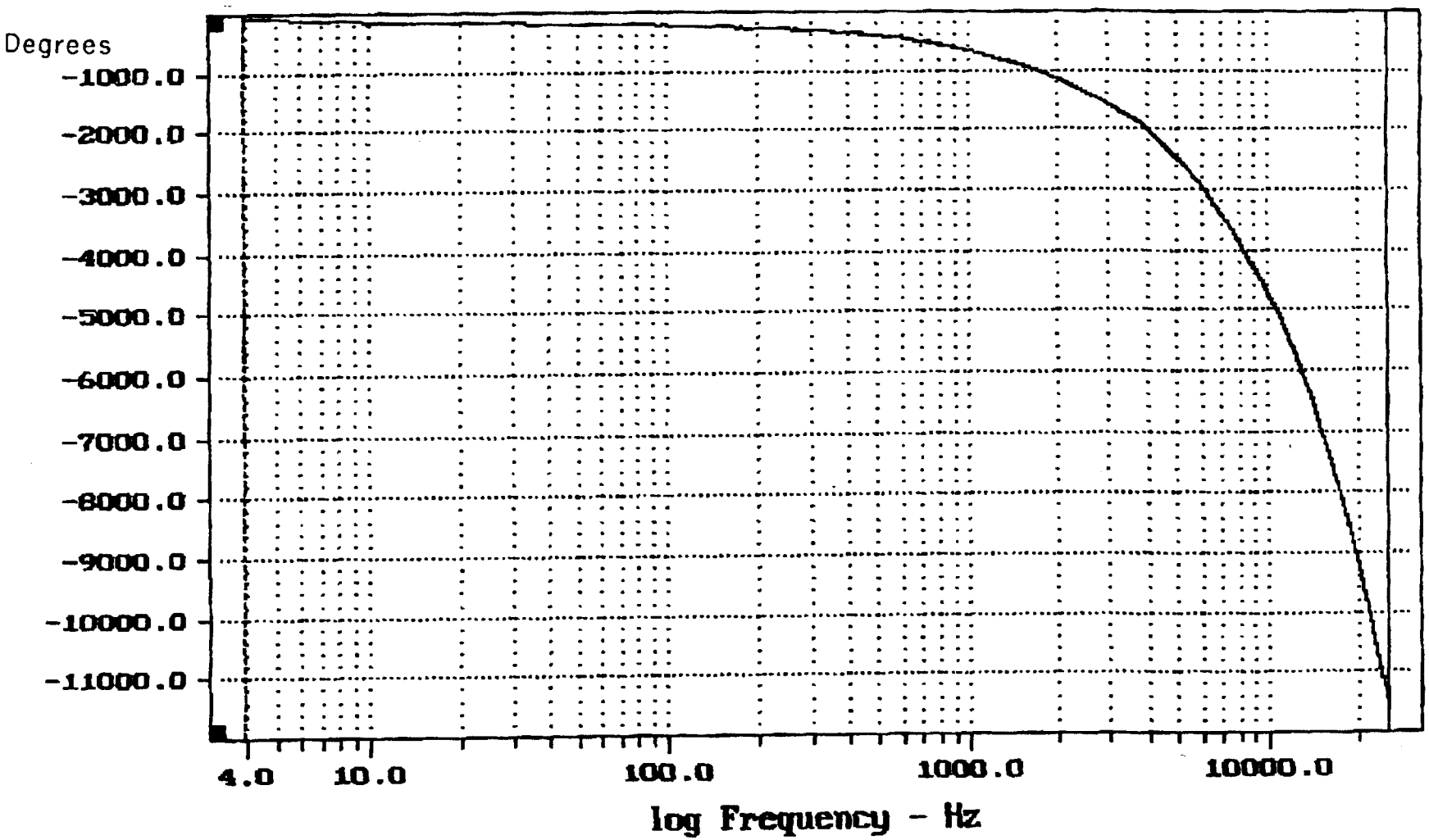
Figure 2C:
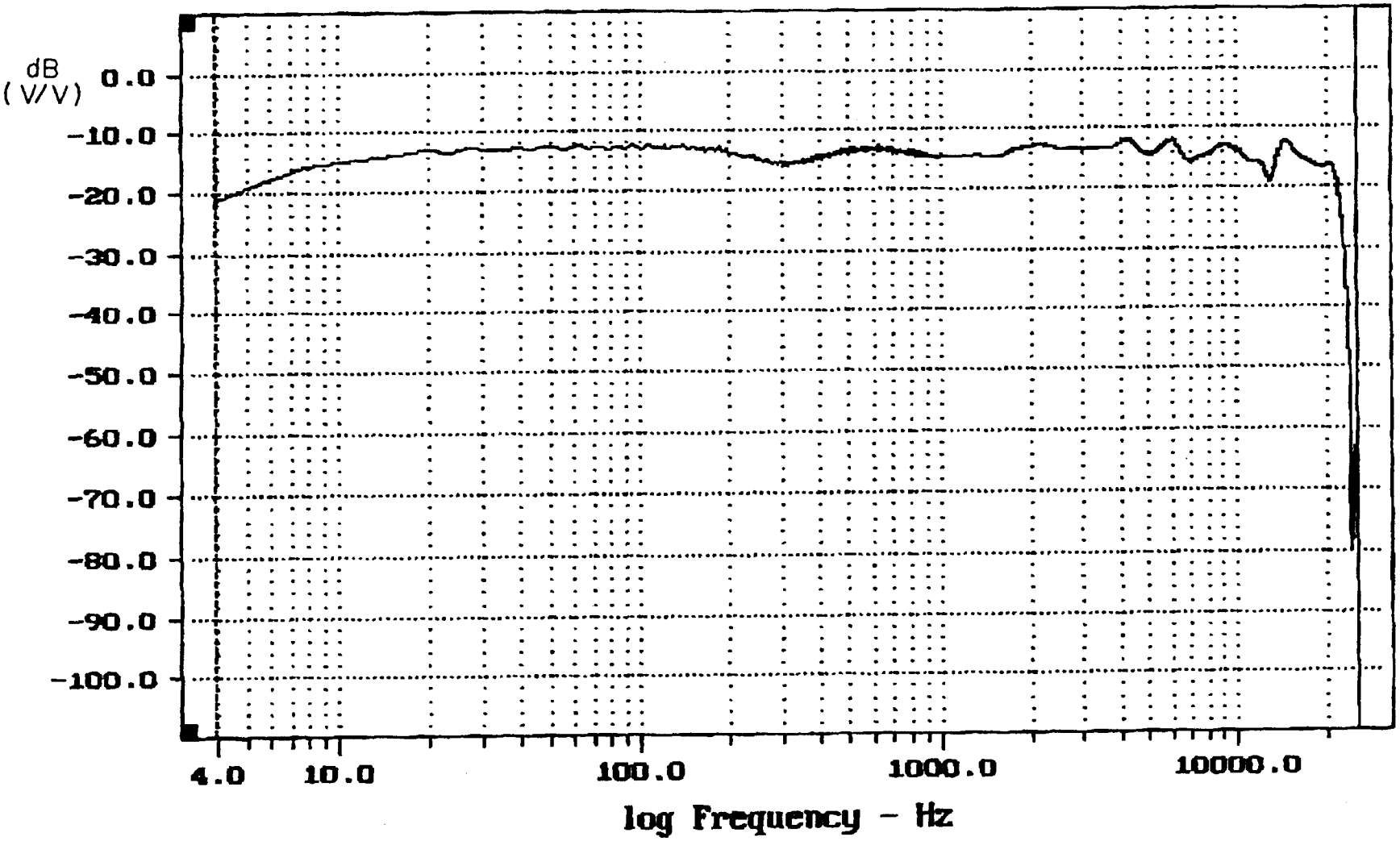
FIGS. 2*c–d* illustrate a transfer function of cross channel interaction of a digital filter for a particular make and model of automobile according to the invention.
Figure 2D:
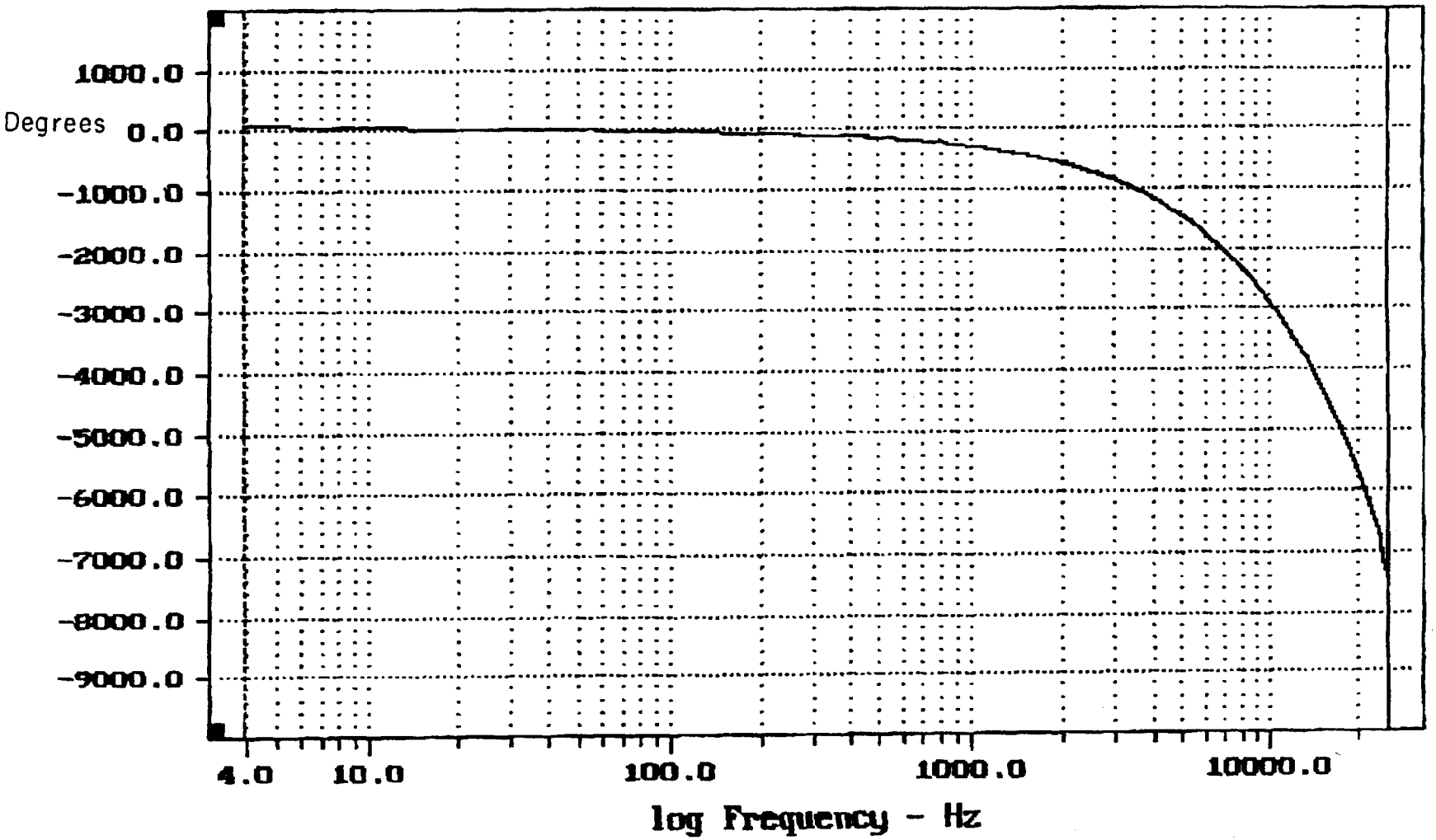

FIG. 2*a* illustrates the magnitude of a suitable transfer function of the DSP 32 filter channel between its input port LF and equalizers 82 and 94 for a 1997 BMW 700 series body in dB(volts/volts) versus the logarithm of frequency. FIG. 2*b* illustrates the phase of a suitable transfer function of the DSP 32 filter channel between its input port LF and equalizers 82 and 94 for a 1997 BMW 700 series body in degrees versus the logarithm of frequency. FIG. 2*c* illustrates the magnitude of a suitable transfer function of the DSP 32 filter between its input port LF and equalizers 84 and 96 for the above-identified vehicle in dB versus the logarithm of frequency. FIG. 2*d* illustrates the phase of a suitable transfer function of the DSP 32 filter between its input port LF and equalizers 84 and 96 for the above-identified vehicle in degrees versus the logarithm of frequency.

Figure 3A:
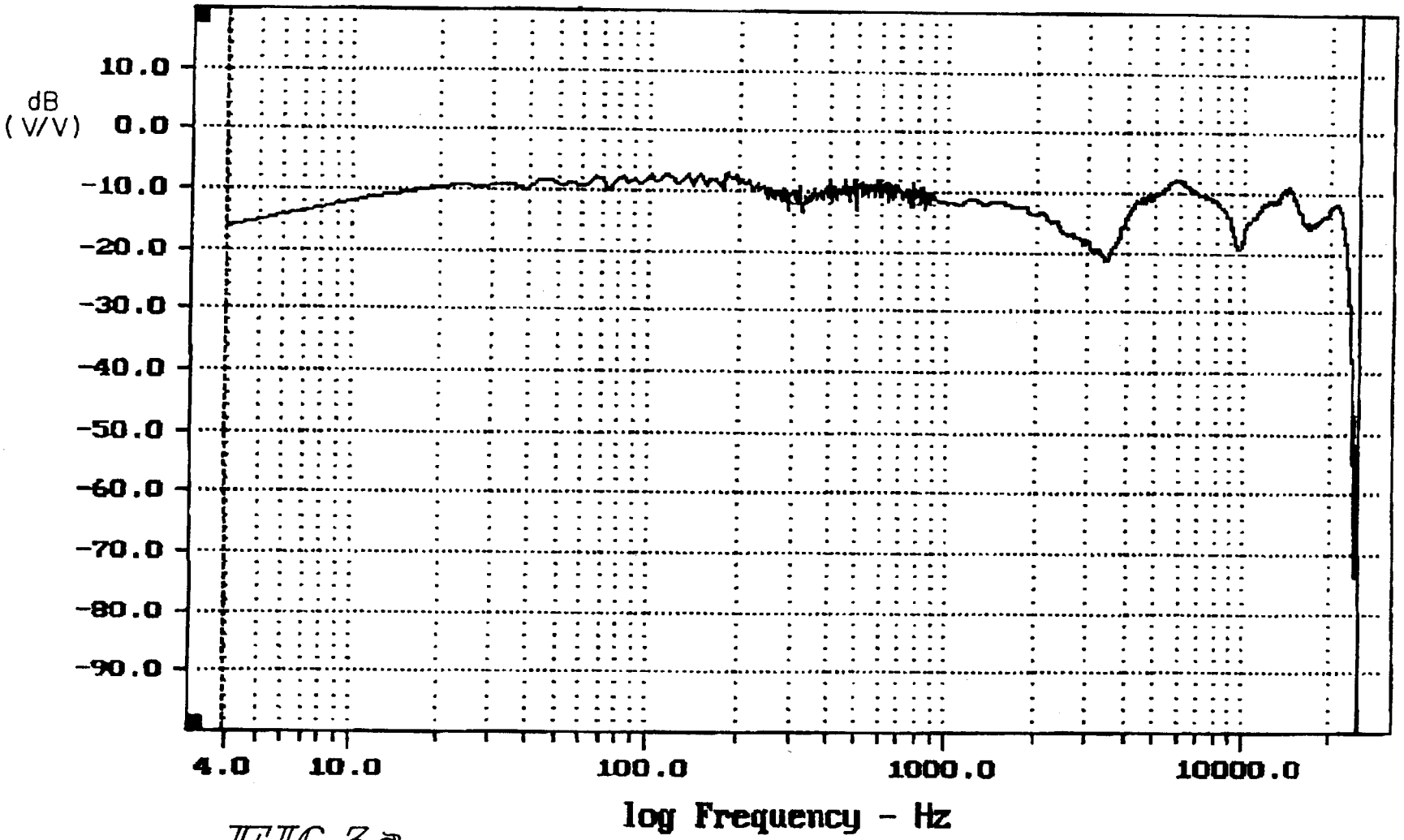
FIGS. 3*a–b* illustrate a transfer function of a channel of a digital filter for a particular make and model of automobile according to the invention.
Figure 3B:
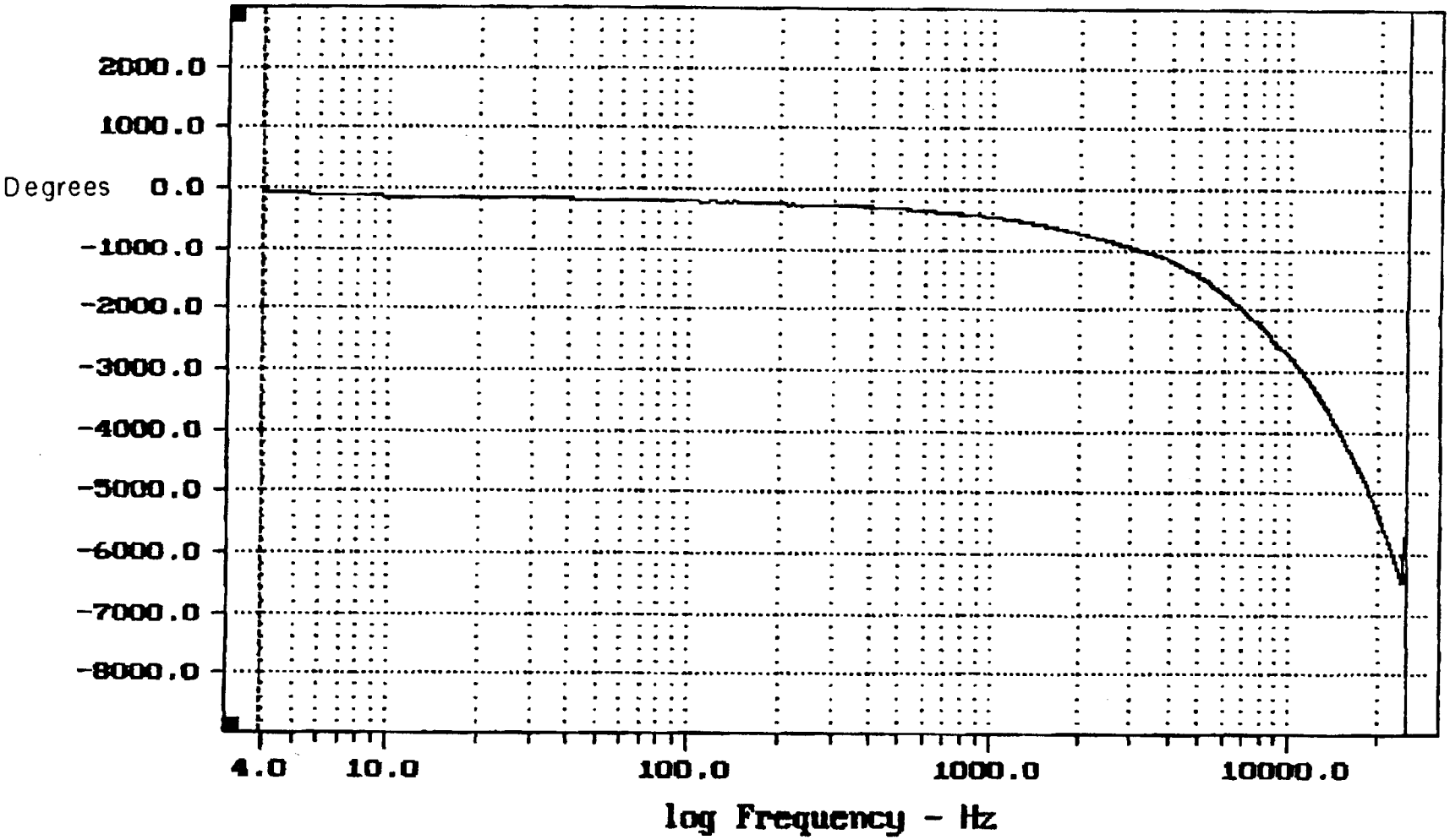
Figure 3C:
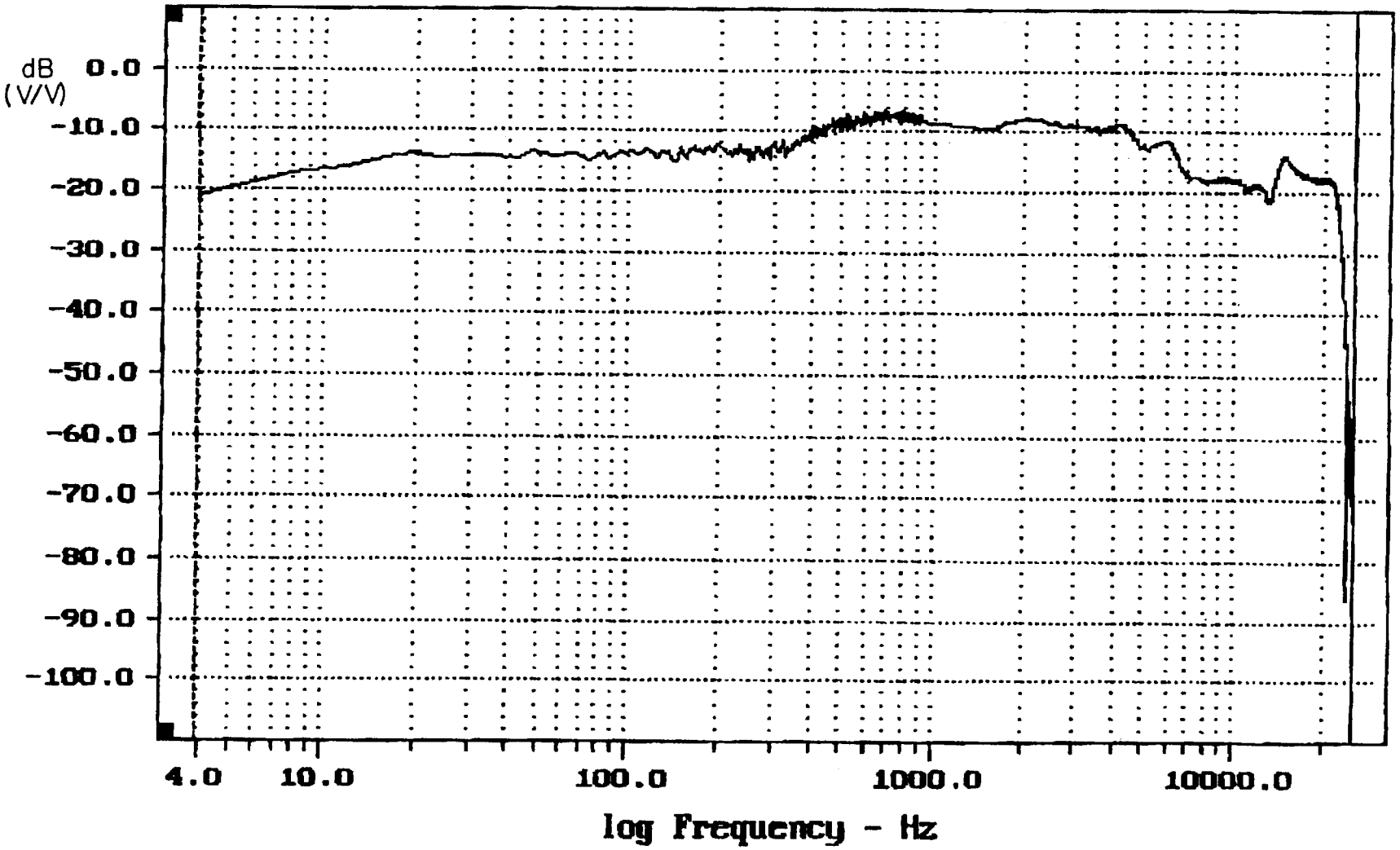
FIGS. 3*c–d* illustrate a transfer function of cross channel interaction of a digital filter for a particular make and model of automobile according to the invention.
Figure 3D:
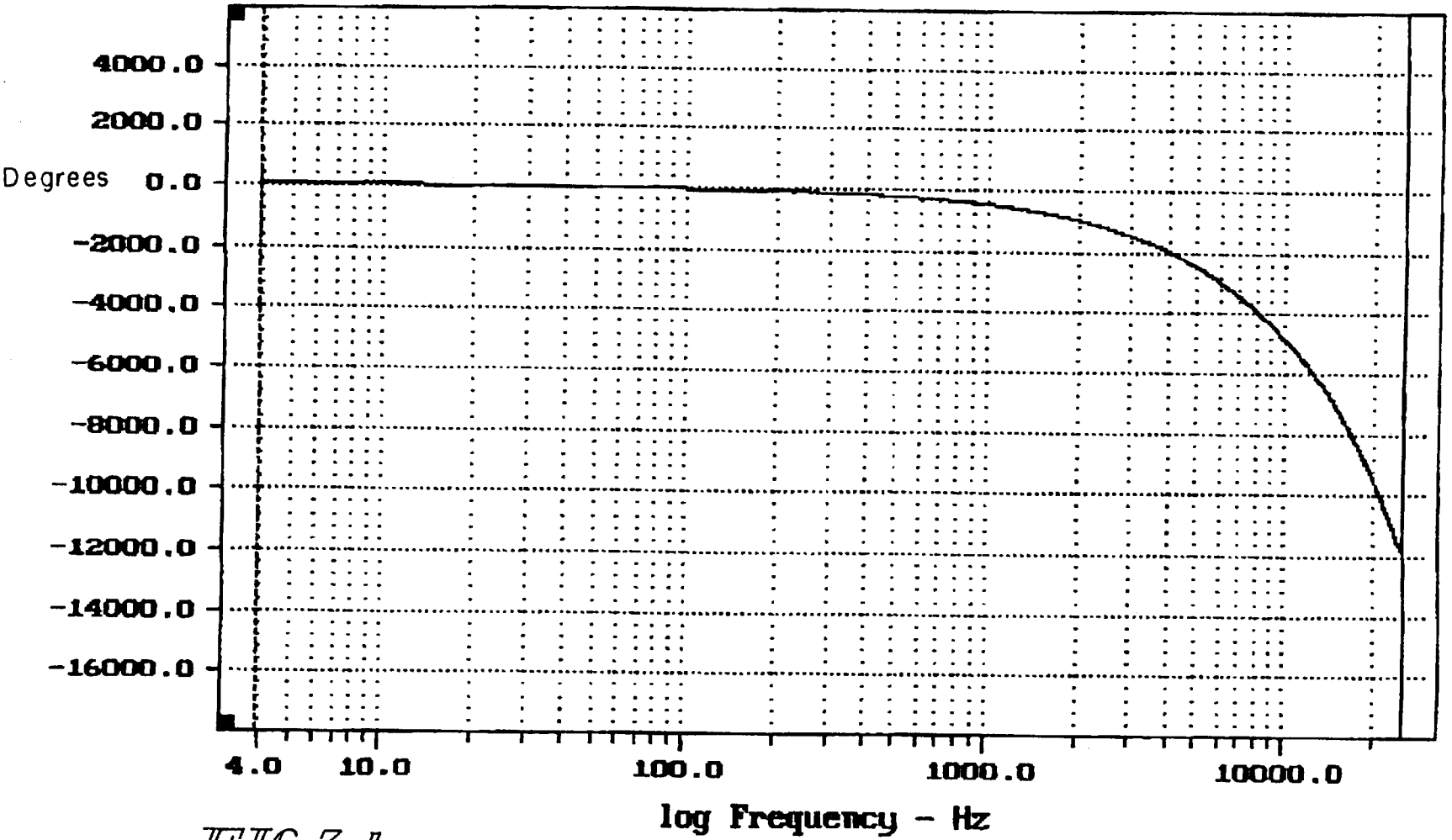

FIG. 3*a* illustrates the magnitude of a suitable transfer function of the DSP 32 filter channel between its input port RF and equalizers 84 and 96 for the above identified vehicle in dB versus the logarithm of frequency. FIG. 3*b* illustrates the phase of a suitable transfer function of the DSP 32 filter channel between its input port RF and equalizers 84 and 96 for the above identified vehicle in degrees versus the logarithm of frequency. FIG. 3*c* illustrates the magnitude of a suitable transfer function of the DSP 32 filter between its input port RF and equalizers 82 and 94 for the above-identified vehicle in dB versus the logarithm of frequency. FIG. 3*d* illustrates the phase of a suitable transfer function of the DSP 32 filter between its input port RF and equalizers 82 and 94 for the above-identified vehicle in degrees versus the logarithm of frequency.

Figure 4A:
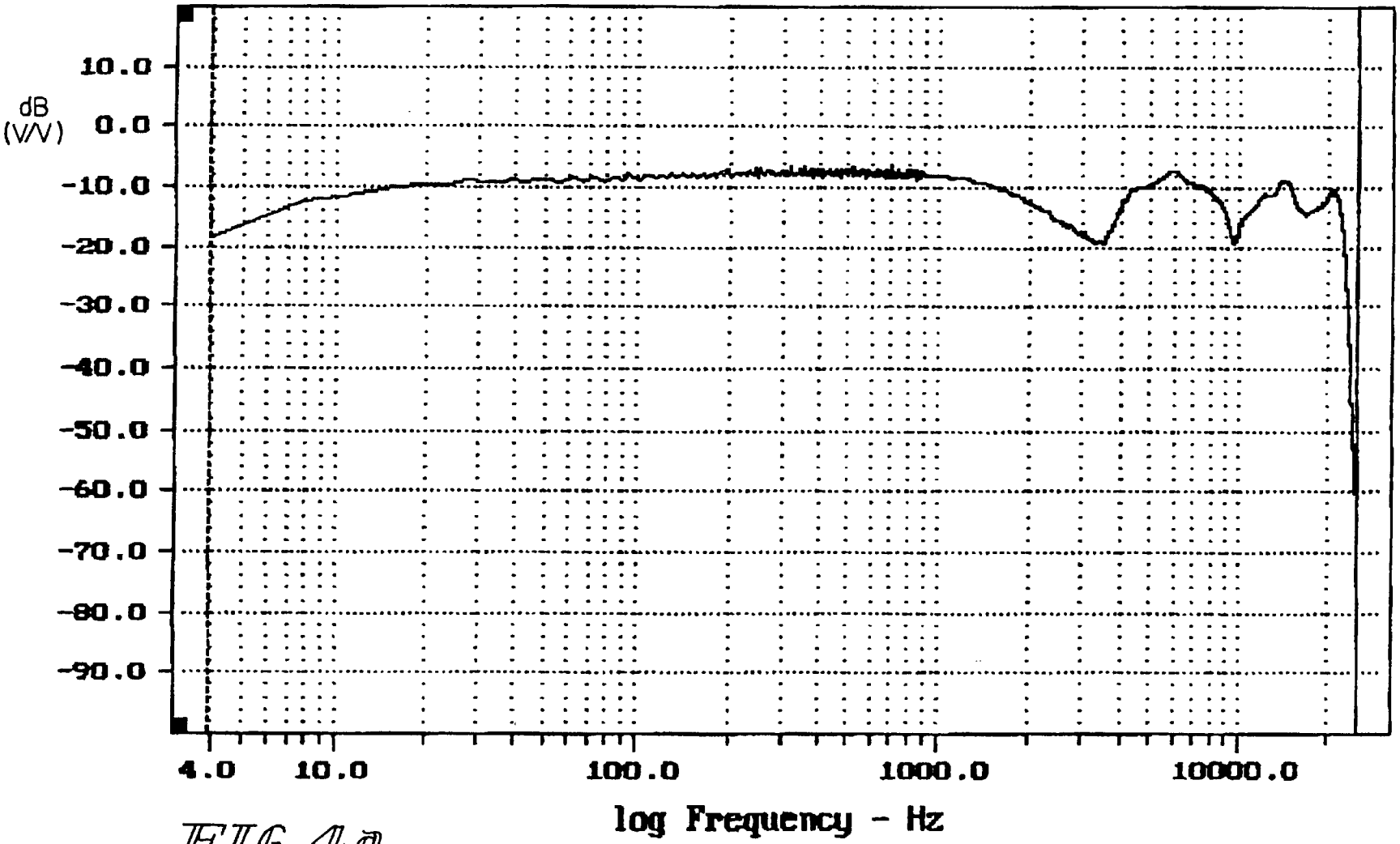
Figure 44:
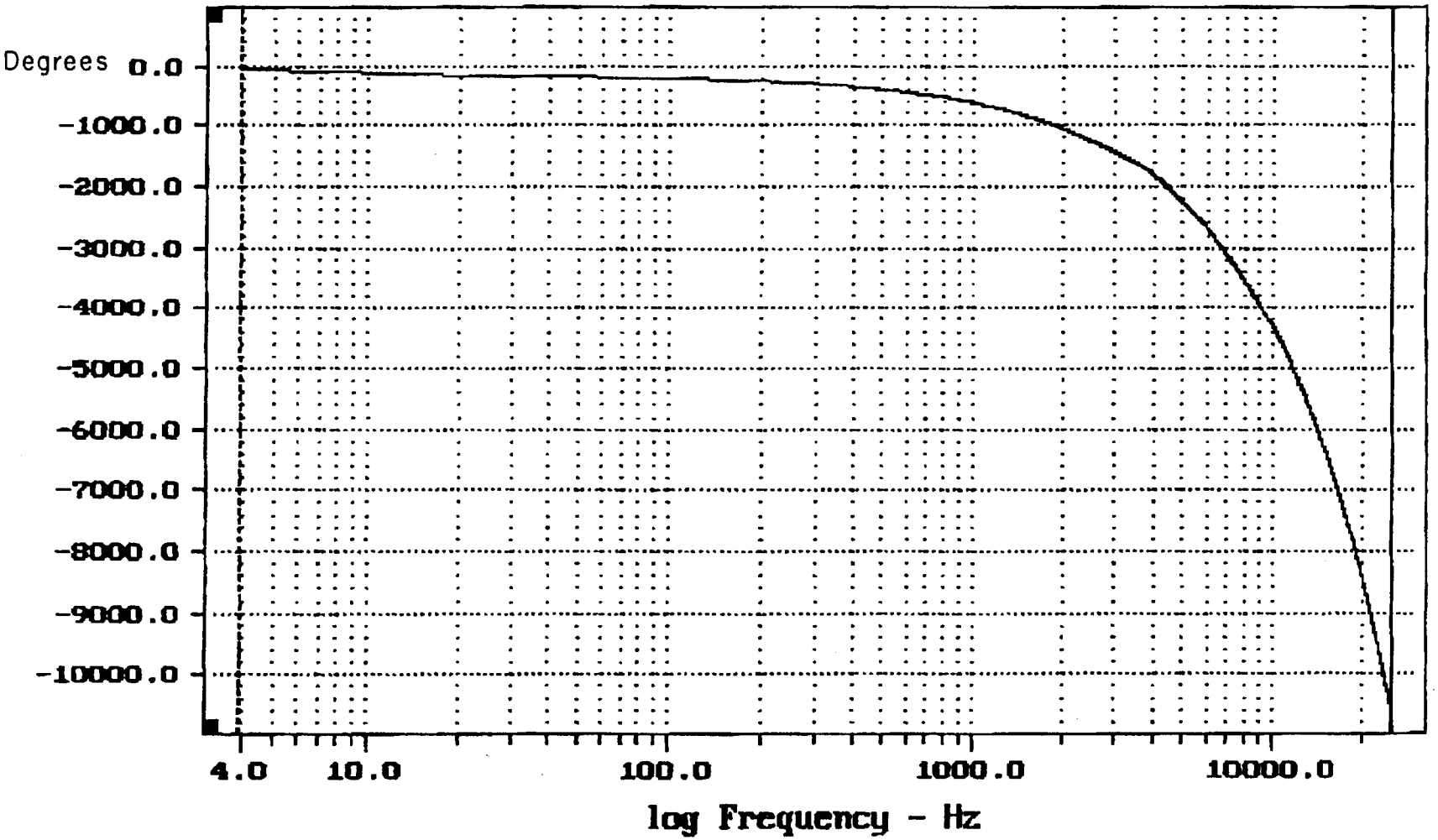
Figure 4C:
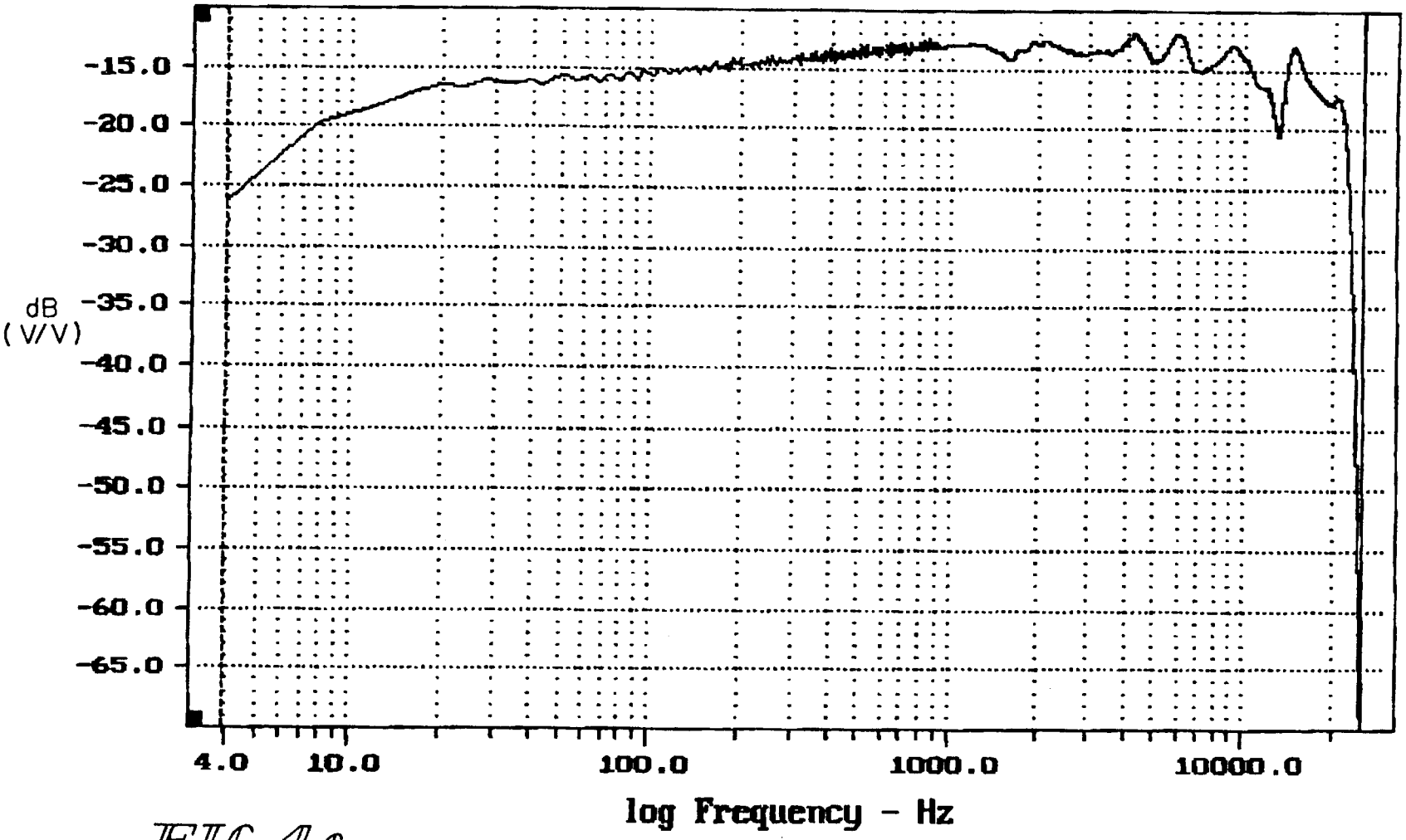
FIGS. 4*c–d* illustrate a transfer function of cross channel interaction of a digital filter for a particular make and model of automobile according to the invention.
Figure 4D:
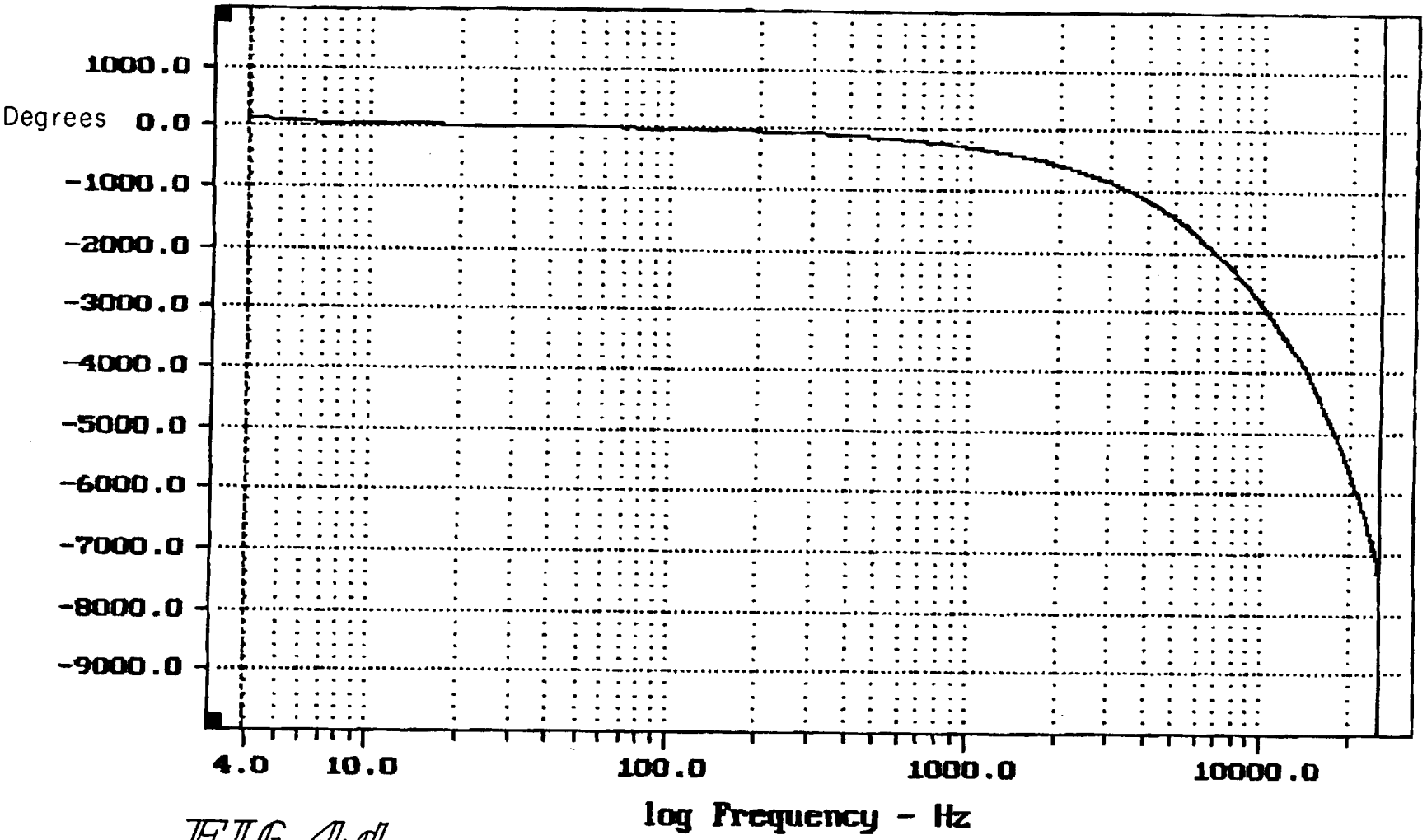

FIG. 4*a* illustrates the magnitude of a suitable transfer function of the DSP 32 filter channel between its input port LR and equalizers 98 and 110 for the above identified vehicle in dB versus the logarithm of frequency. FIG. 4*b* illustrates the phase of a suitable transfer function of the DSP 32 filter channel between its input port LR and equalizers 98 and 110 for the above identified vehicle in degrees versus the logarithm of frequency. FIG. 4*c* illustrates the magnitude of a suitable transfer function of the DSP 32 filter between its input port LR and equalizers 100 and 112 for the above-identified vehicle in dB versus the logarithm of frequency. FIG. 4*d* illustrates the phase of a suitable transfer function of the DSP 32 filter between its input port LR and equalizers 100 and 112 for the above-identified vehicle in degrees versus the logarithm of frequency.

Figure 5A:
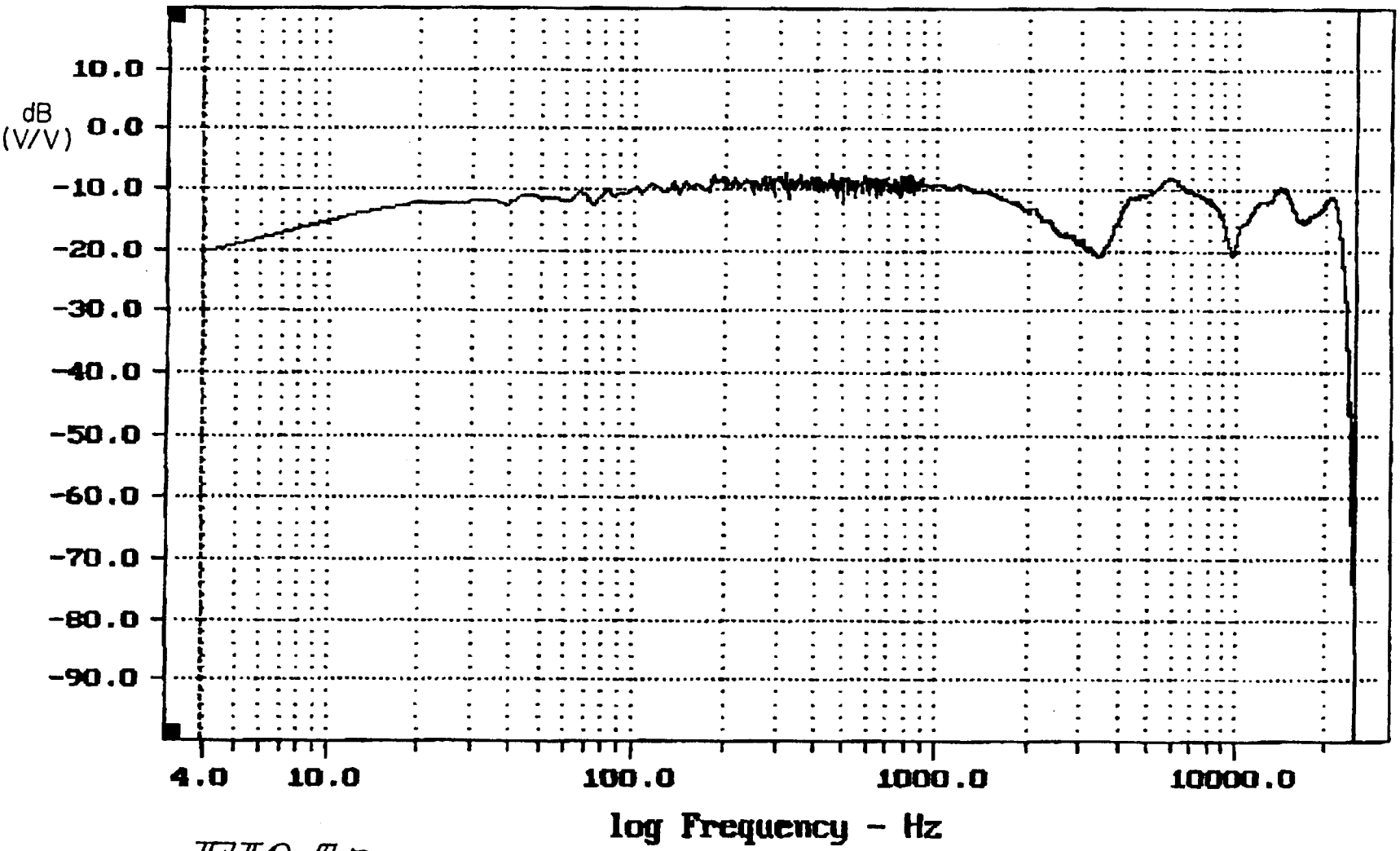
FIGS. 5*a–b* illustrate a transfer function of a channel of a digital filter for a particular make and model of automobile according to the invention.
Figure 5B:
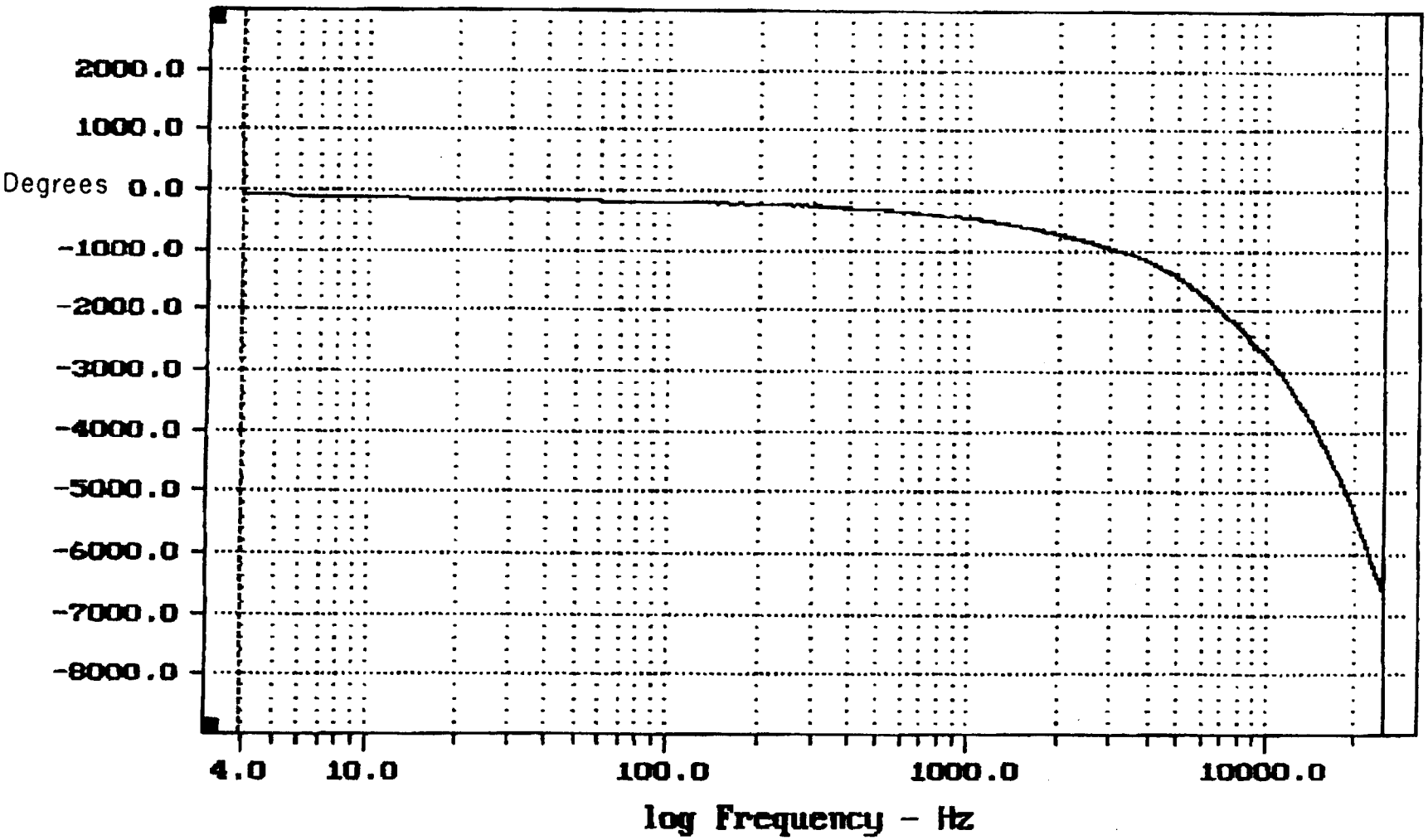
Figure 5C:
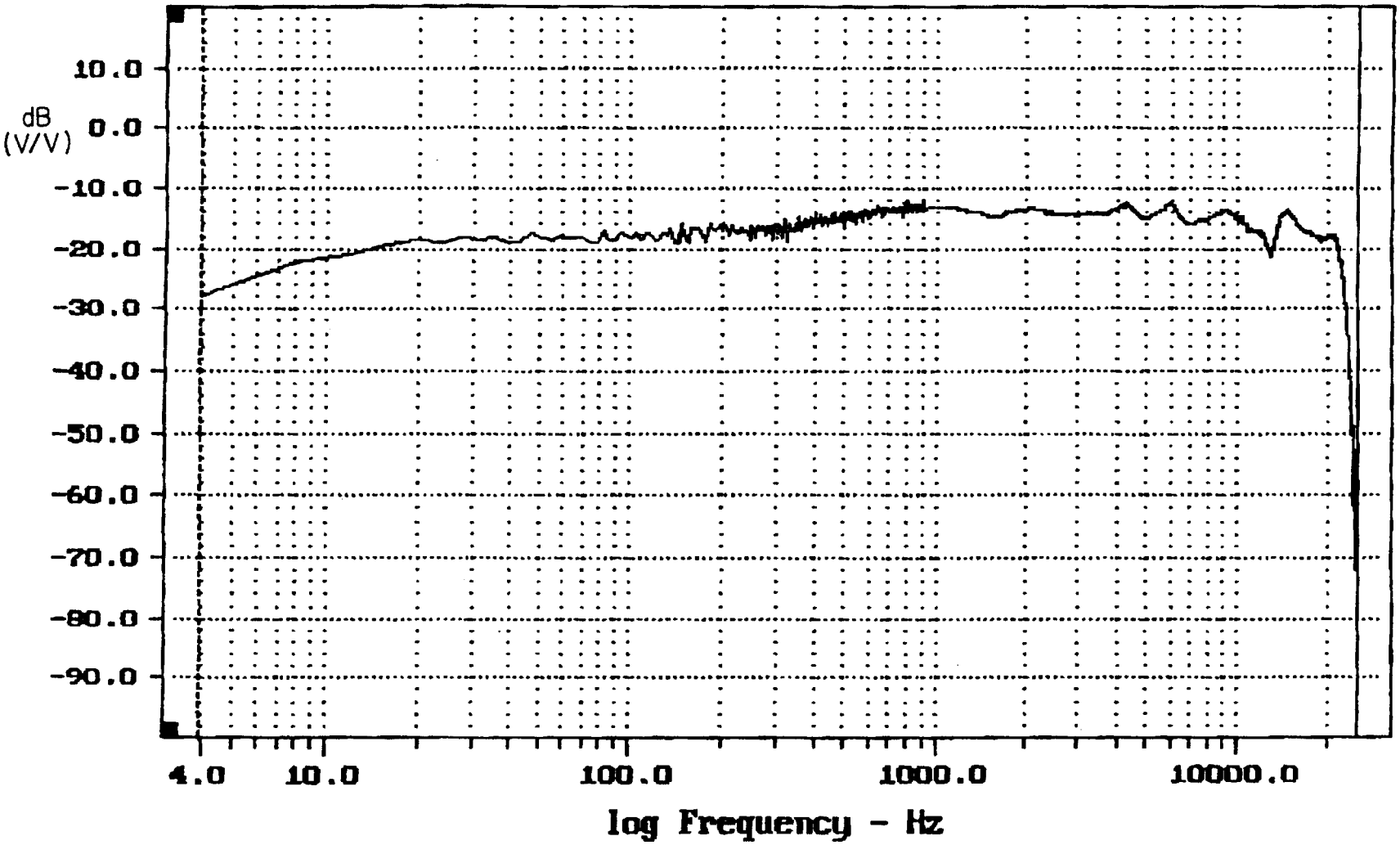
FIGS. 5*c–d* illustrate a transfer function of cross channel interaction of a digital filter for a particular make and model of automobile according to the invention.
Figure 5D:
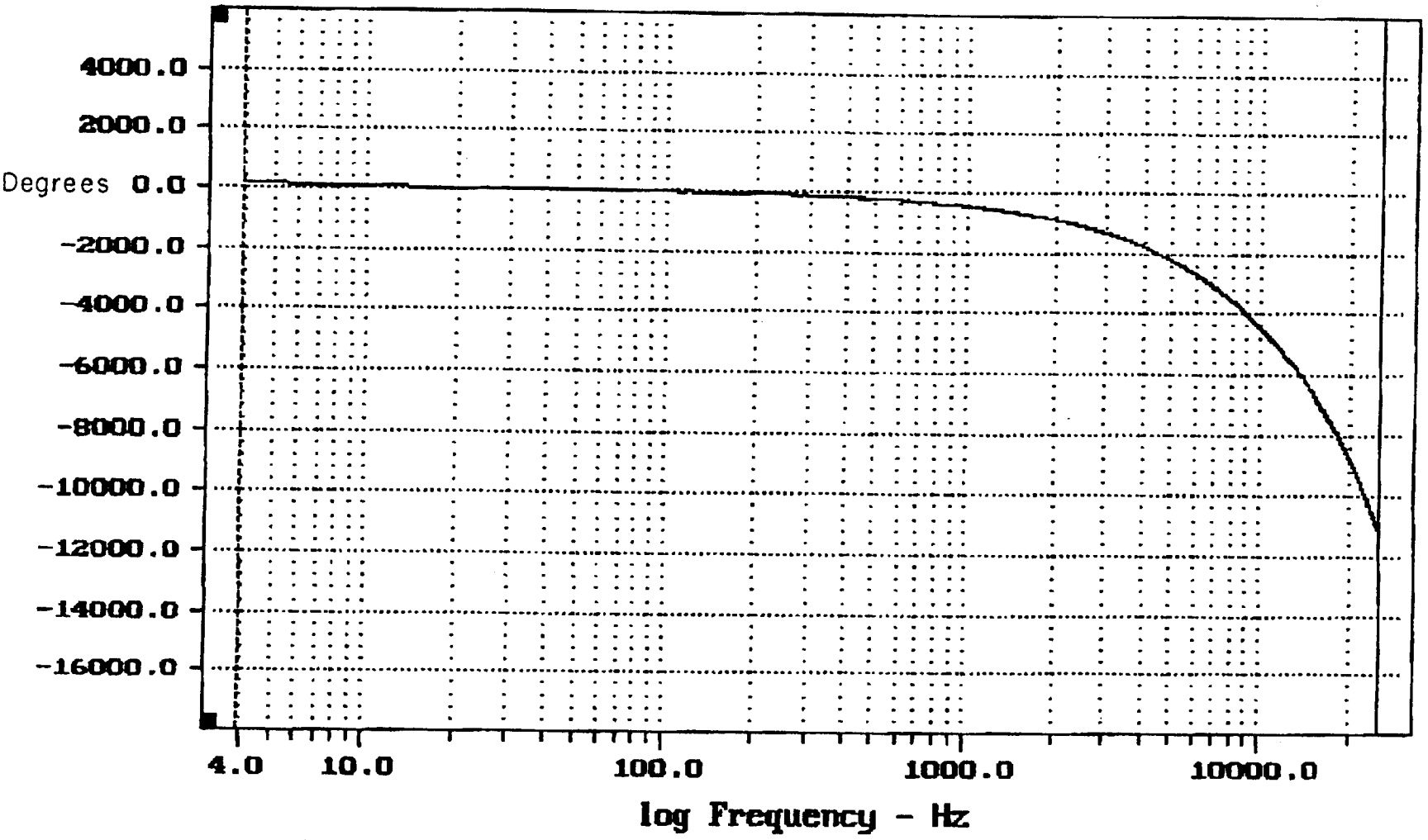

FIG. 5*a* illustrates the magnitude of a suitable transfer function of the DSP 32 filter channel between its input port RR and equalizers 100 and 112 for the above identified vehicle in dB versus the logarithm of frequency. FIG. 5*b* illustrates the phase of a suitable transfer function of the DSP 32 filter channel between its input port RR and equalizers 100 and 112 for the above identified vehicle in degrees versus the logarithm of frequency. FIG. 5*c* illustrates the magnitude of a suitable transfer function of the DSP 32 filter between its input port RR and equalizers 98 and 110 for the above-identified vehicle in dB versus the logarithm of frequency. FIG. 5*d* illustrates the phase of a suitable transfer function of the DSP 32 filter between its input port RR and equalizers 98 and 110 for the above-identified vehicle in degrees versus the logarithm of frequency.

Figure 6A:
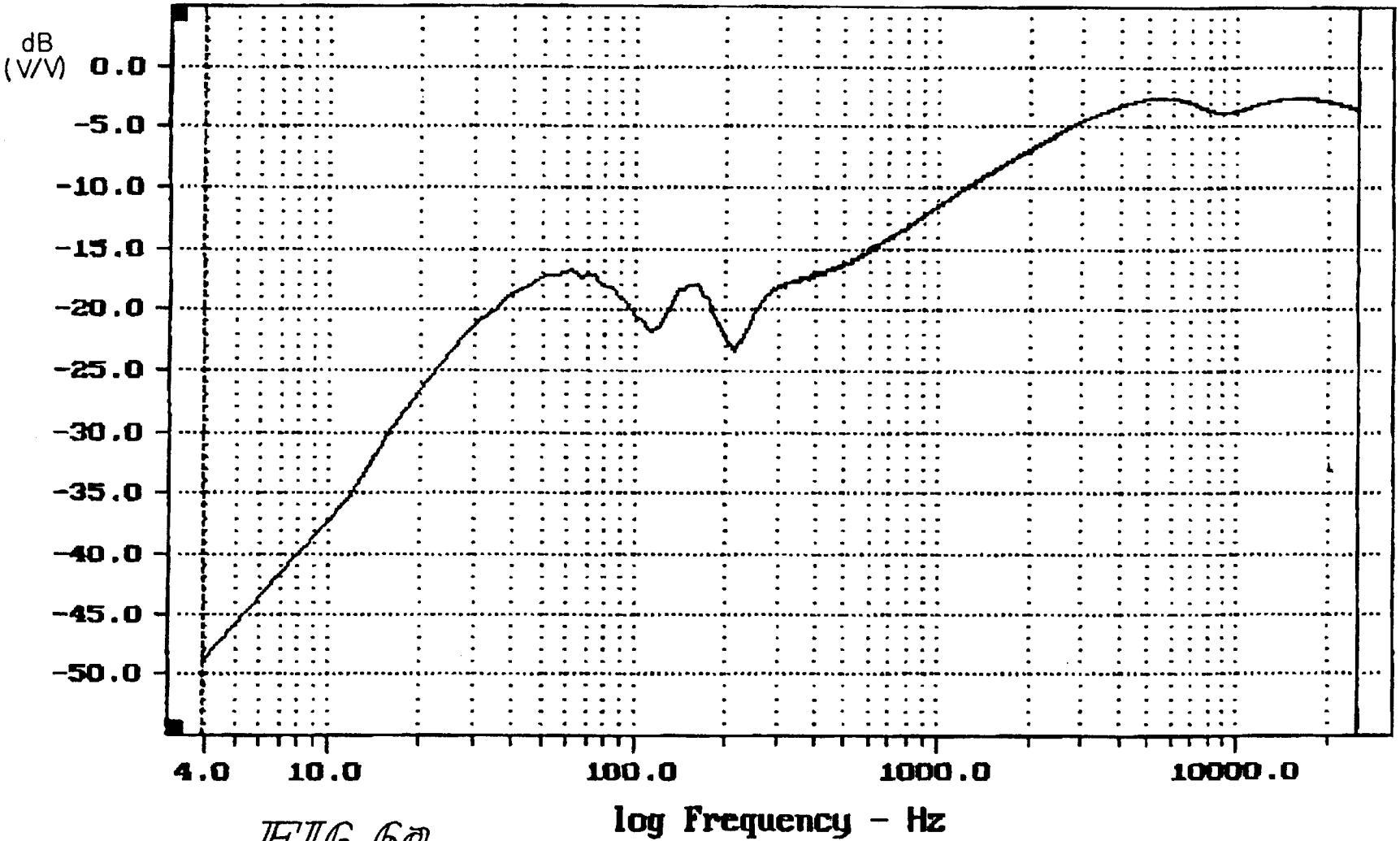
FIGS. 6*a–b* illustrate a transfer function of an equalization and filtering channel for a particular make and model of automobile according to the invention.
Figure 6B:
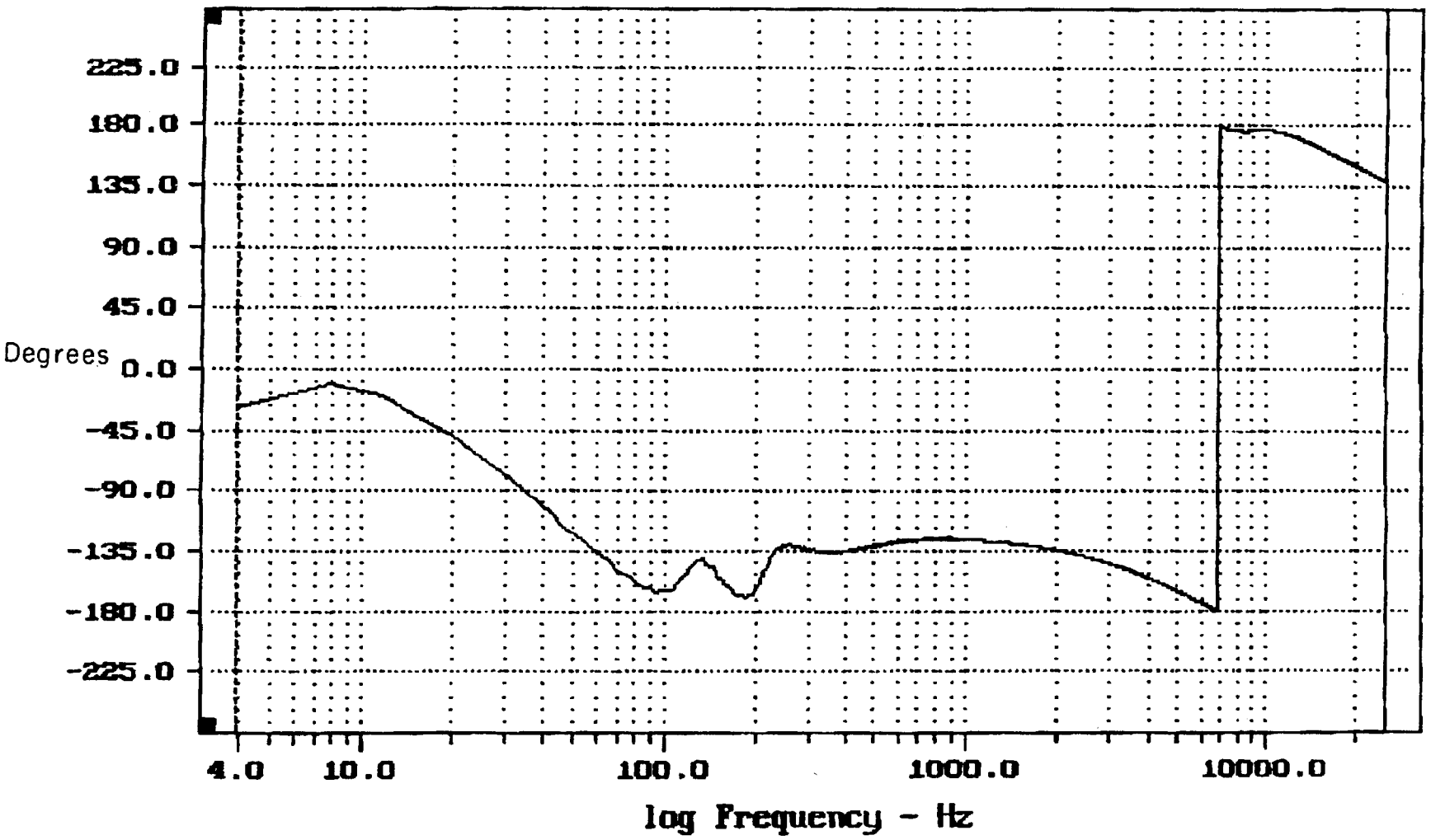

FIG. 6*a* illustrates the magnitude of a suitable transfer function of equalizer 82 for the above identified vehicle in dB versus the logarithm of frequency. FIG. 6*b* illustrates the phase of a suitable transfer function of equalizer 82 for the above identified vehicle in degrees versus the logarithm of frequency.

Figure 7A:
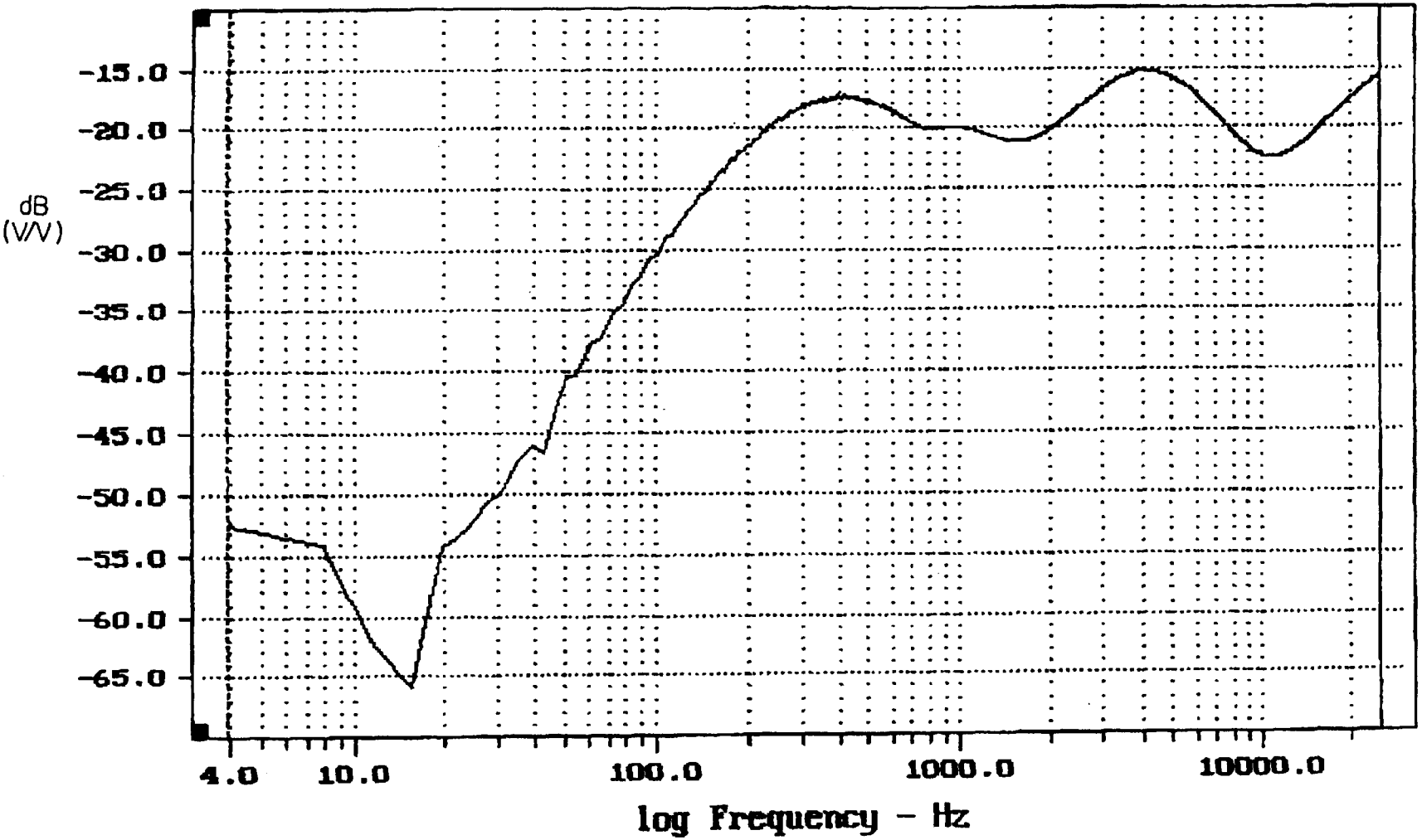
FIGS. 7*a–b* illustrate a transfer function of an equalization and filtering channel for a particular make and model of automobile according to the invention.
Figure 7B:
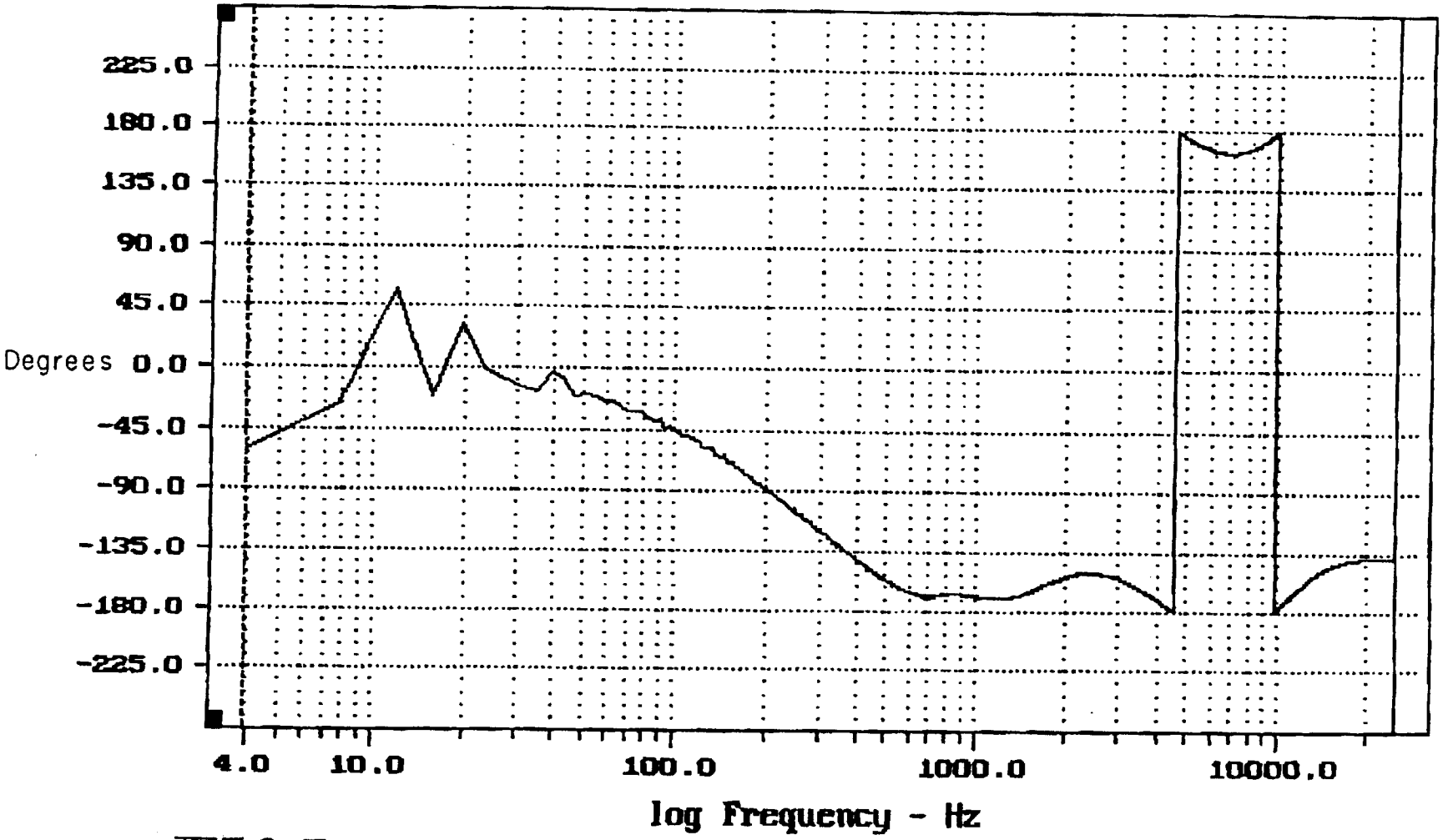

FIG. 7*a* illustrates the magnitude of a suitable transfer function of equalizer 94 for the above identified vehicle in dB versus the logarithm of frequency. FIG. 7*b* illustrates the phase of a suitable transfer function of equalizer 94 for the above identified vehicle in degrees versus the logarithm of frequency.

Figure 8A:
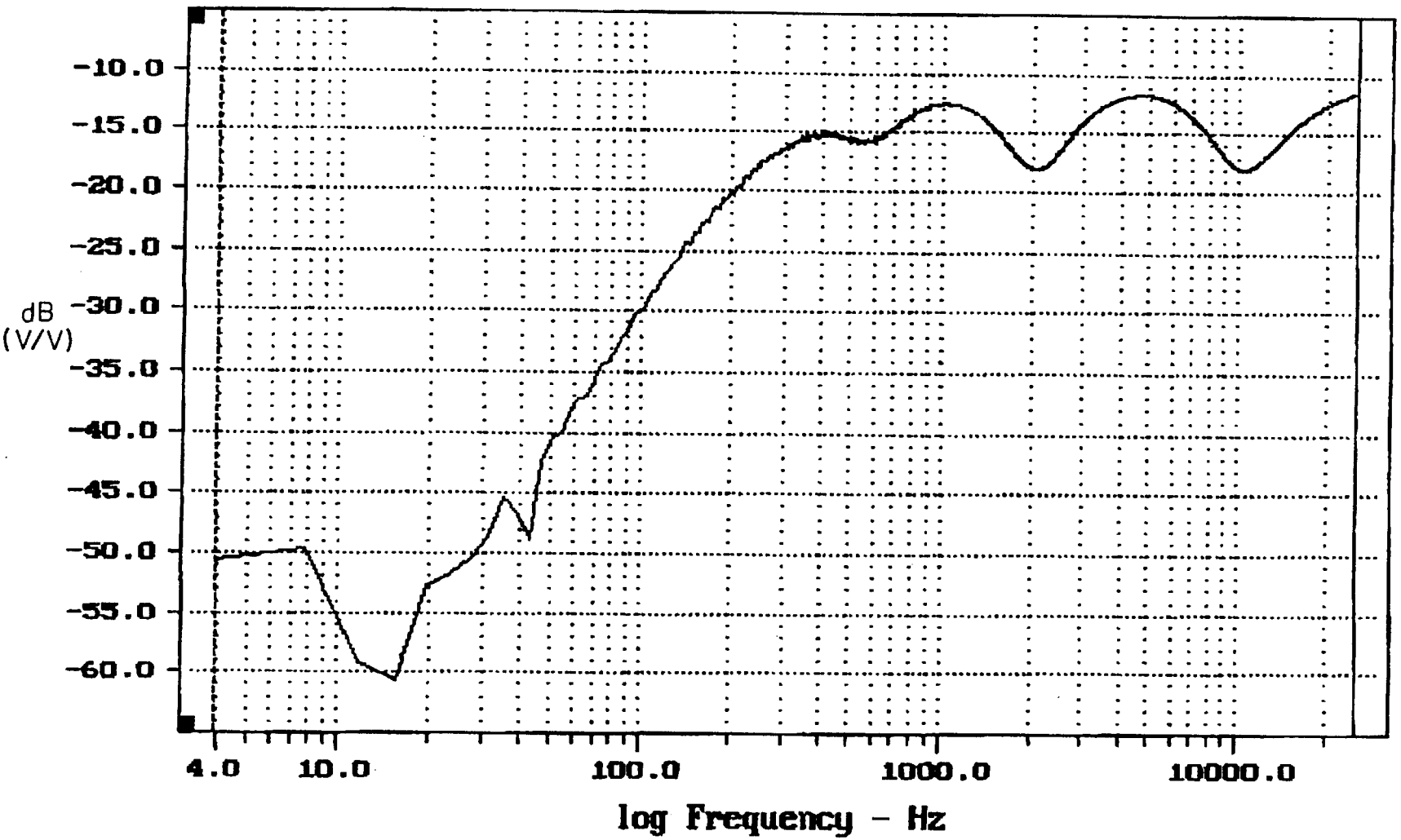
FIGS. 8*a–b* illustrate a transfer function of an equalization and filtering channel for a particular make and model of automobile according to the invention.
Figure 8B:
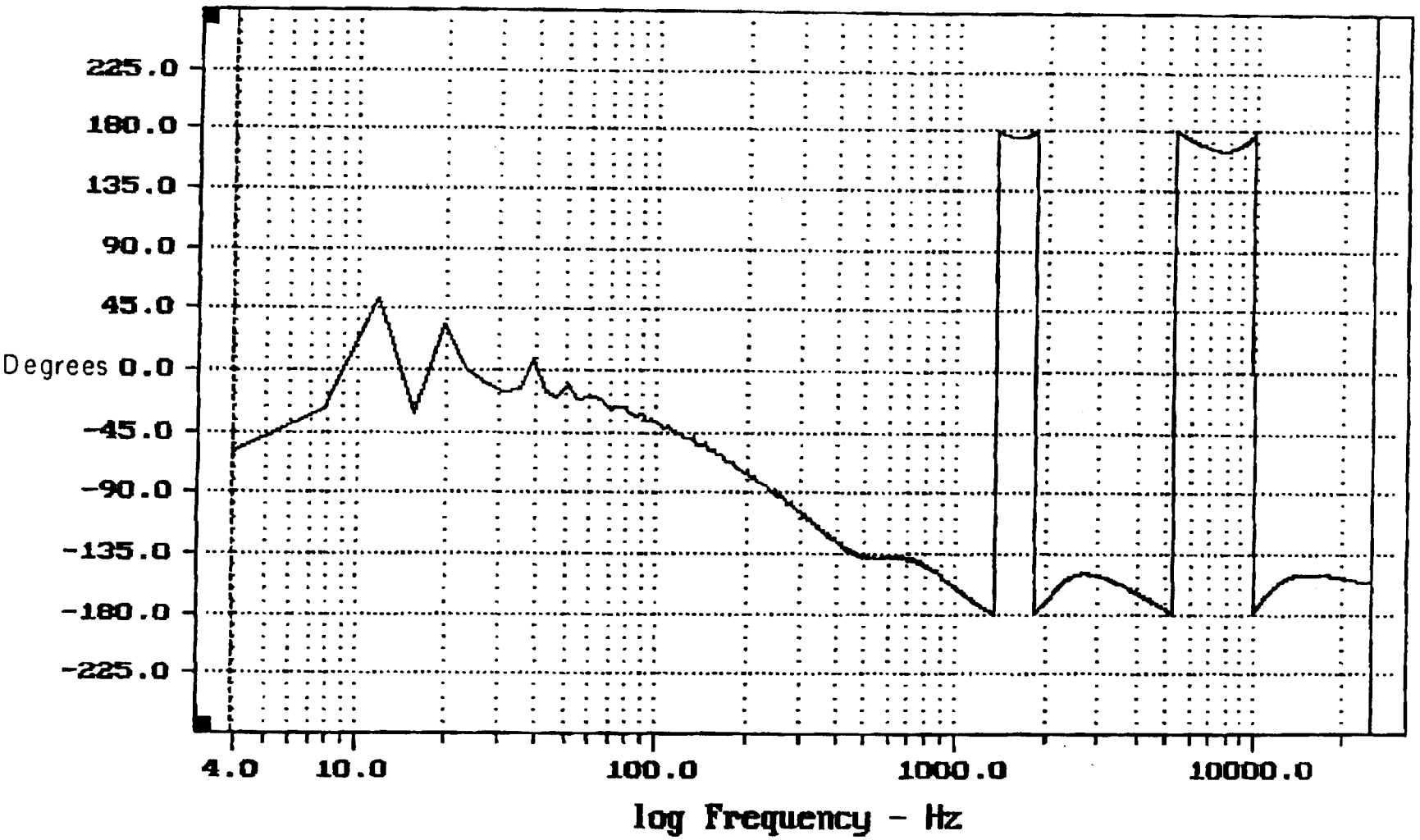

FIG. 8*a* illustrates the magnitude of a suitable transfer function of equalizer 96 for the above identified vehicle in dB versus the logarithm of frequency. FIG. 8*b* illustrates the phase of a suitable transfer function of equalizer 96 for the above identified vehicle in degrees versus the logarithm of frequency.

Figure 9D:
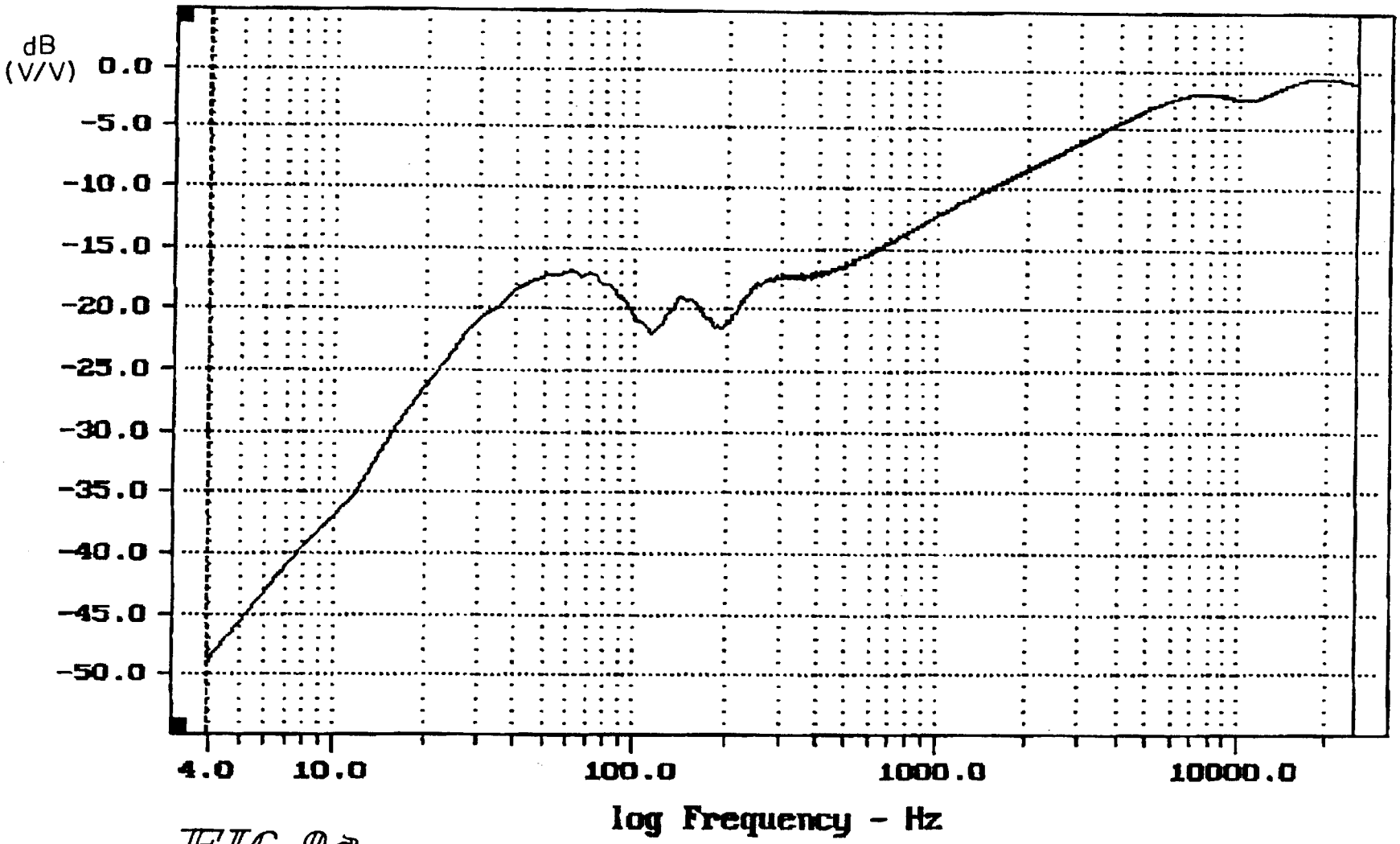
FIGS. 9*a–b* illustrate a transfer function of an equalization and filtering channel for a particular make and model of automobile according to the invention.
Figure 9B:
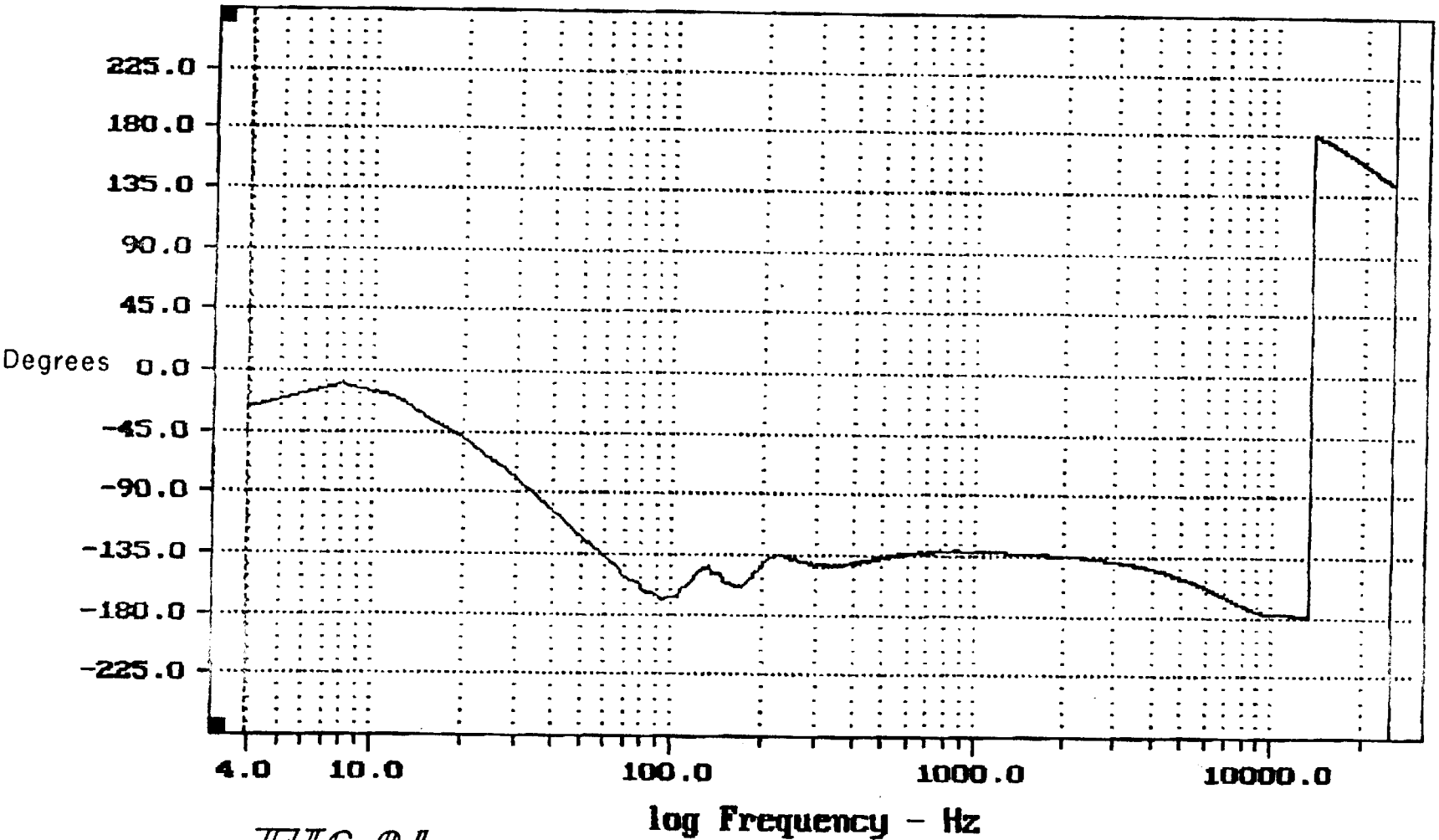

FIG. 9*a* illustrates the magnitude of a suitable transfer function of equalizer 84 for the above identified vehicle in dB versus the logarithm of frequency. FIG. 9*b* illustrates the phase of a suitable transfer function of equalizer 84 for the above identified vehicle in degrees versus the logarithm of frequency.

Figure 10A:
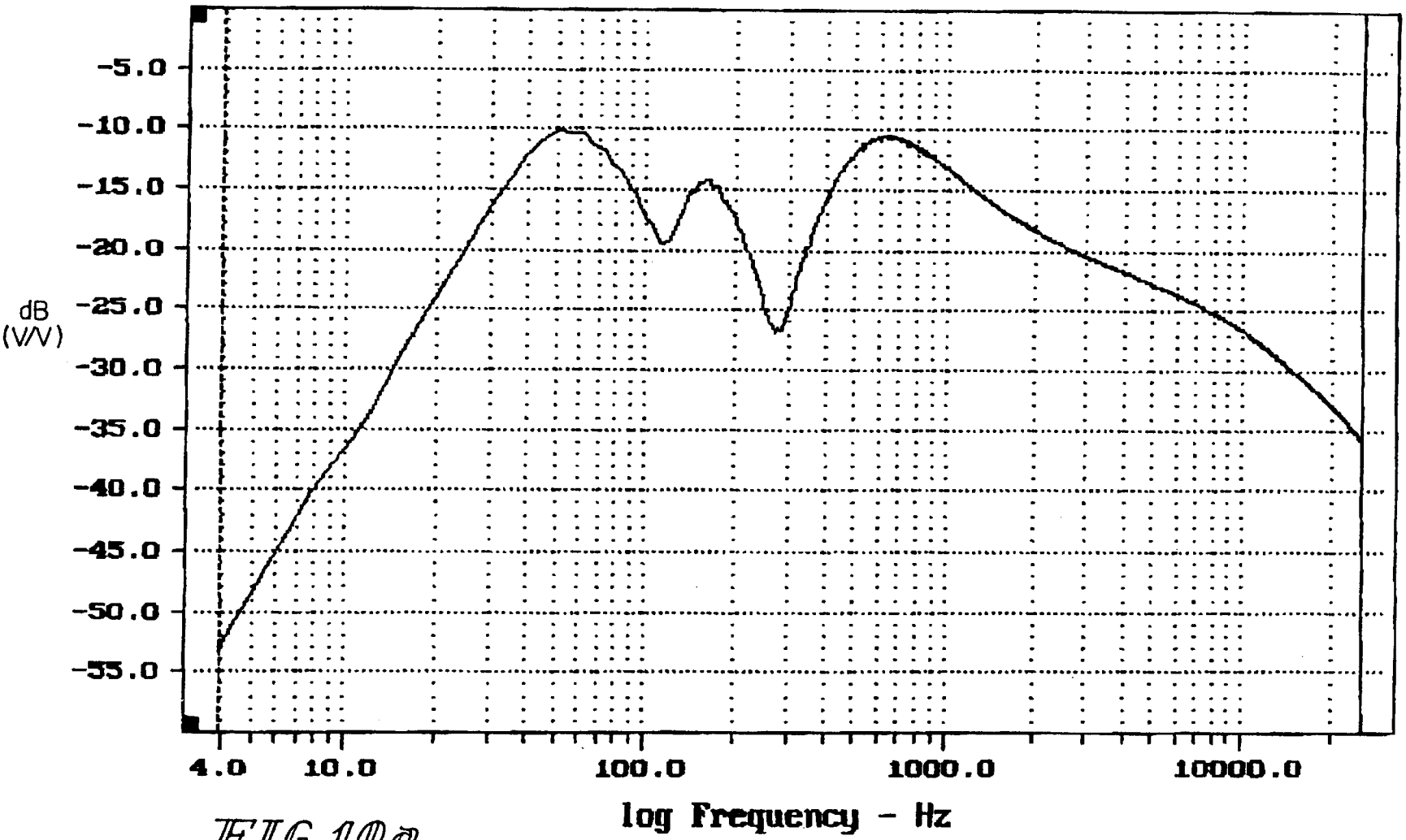
FIGS. 10*a–b* illustrate a transfer function of an equalization and filtering channel for a particular make and model of automobile according to the invention.
Figure 10B:
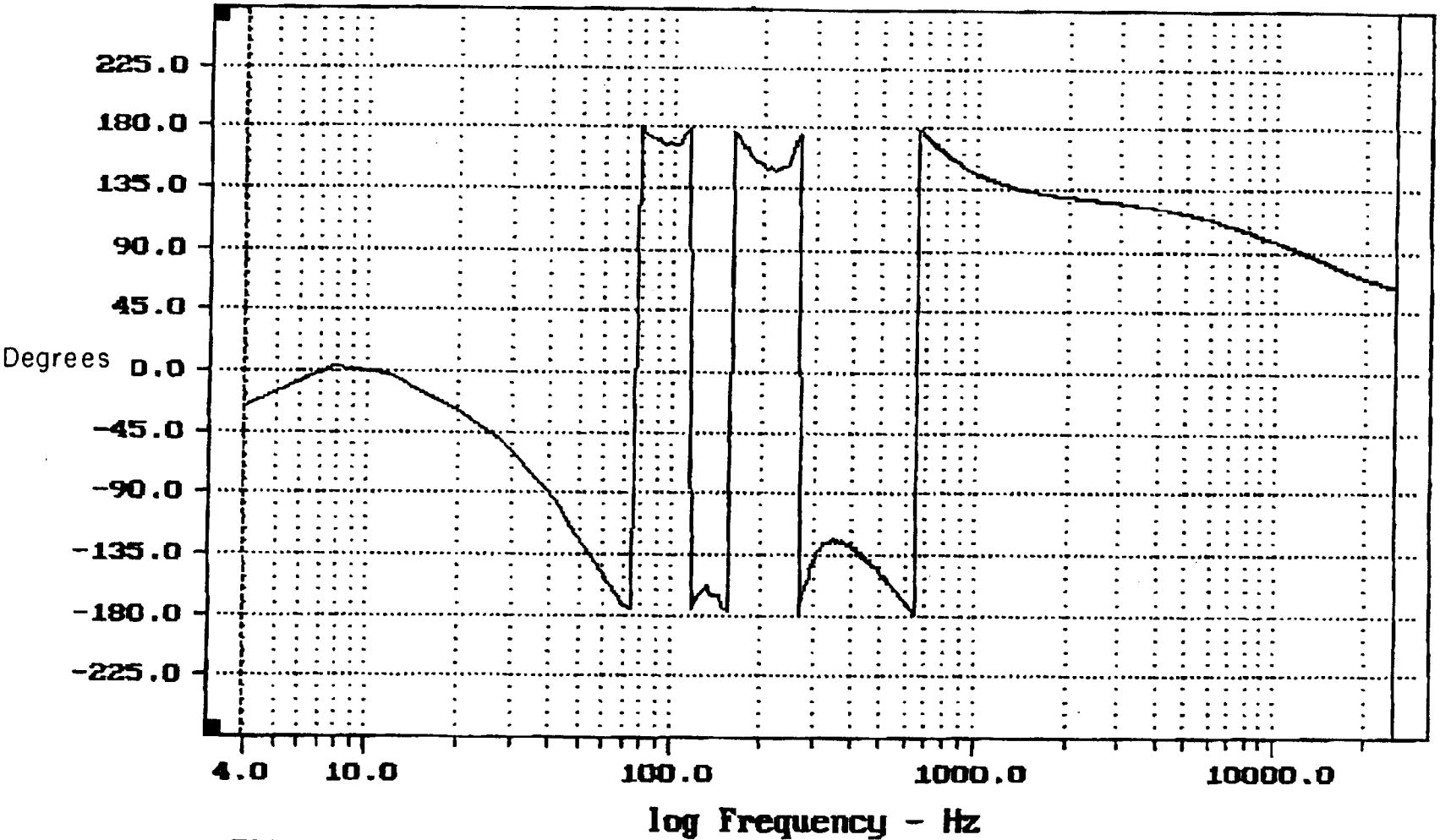

FIG. 10*a* illustrates the magnitude of a suitable transfer function of equalizer 110 for the above identified vehicle in dB versus the logarithm of frequency. FIG. 10*b* illustrates the phase of a suitable transfer function of equalizer 110 for the above identified vehicle in degrees versus the logarithm of frequency.

Figure 11B:
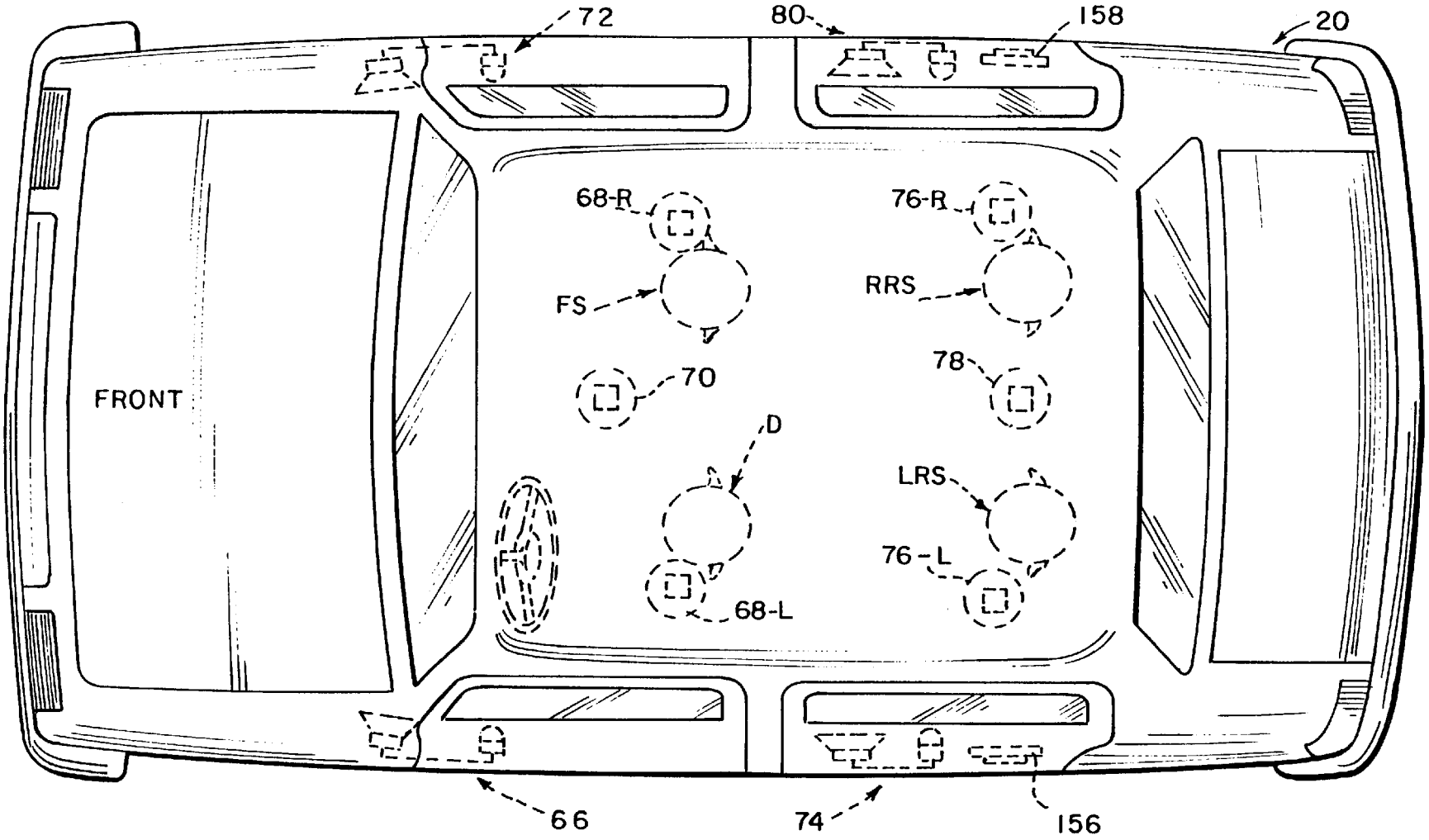
FIGS. 11*a–b* illustrate a transfer function of an equalization and filtering channel for a particular make and model of automobile according to the invention.
Figure 11A:
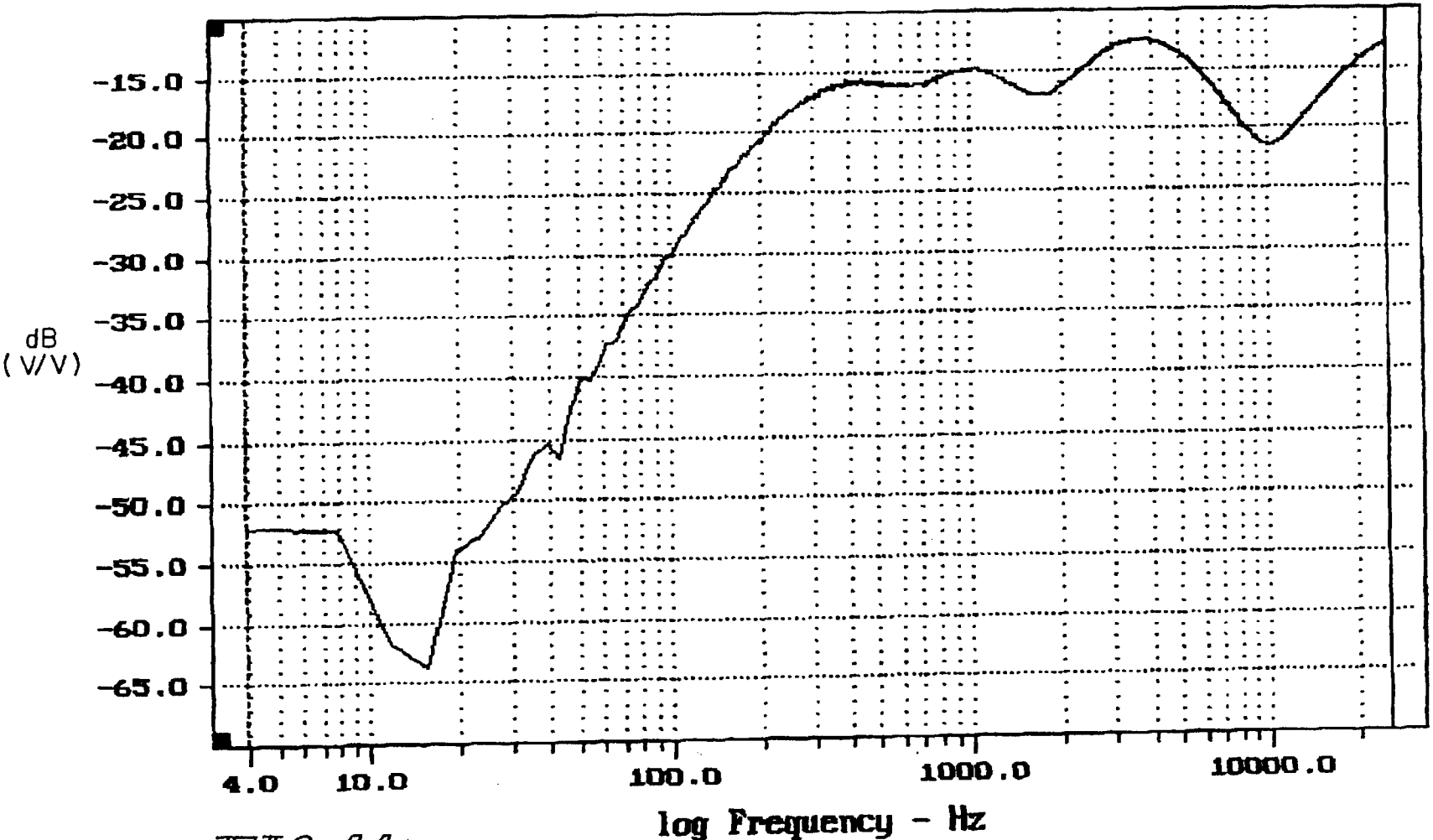
Figure 11B:
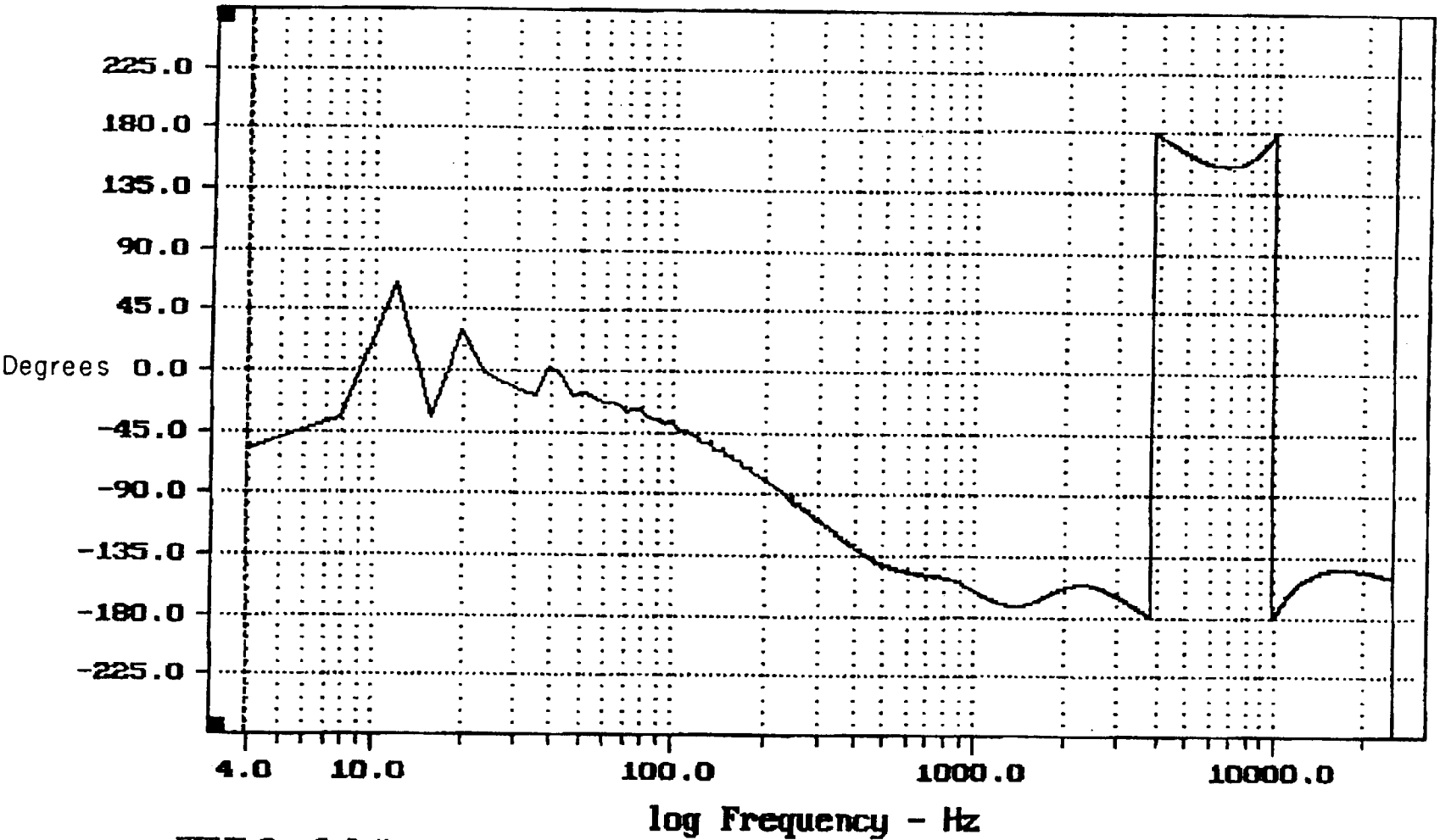

FIG. 11*a* illustrates the magnitude of a suitable transfer function of equalizer 98 for the above identified vehicle in dB versus the logarithm of frequency. FIG. 11*b* illustrates the phase of a suitable transfer function of equalizer 98 for the above identified vehicle in degrees versus the logarithm of frequency.

Figure 12A:
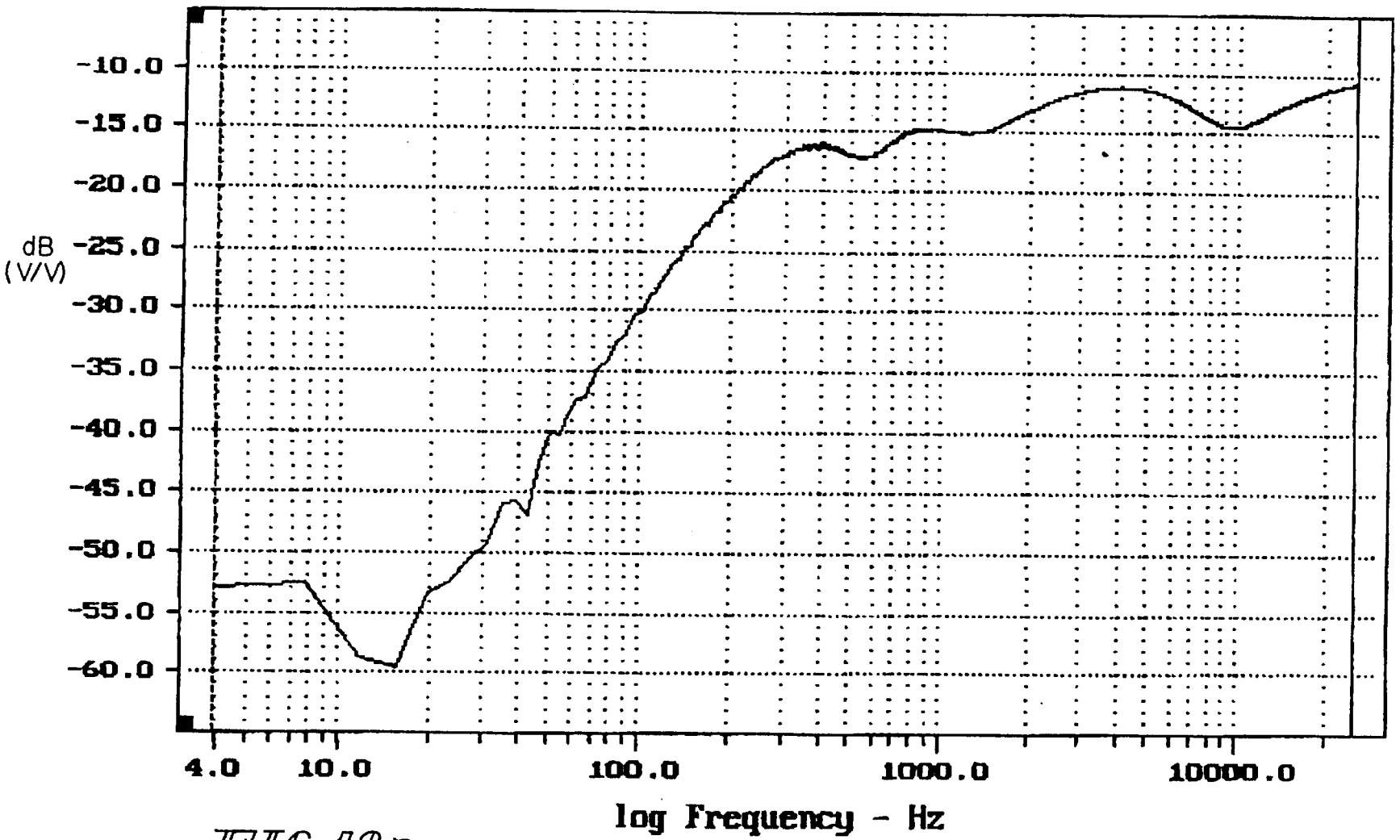
FIGS. 12*a–b* illustrate a transfer function of an equalization and filtering channel for a particular make and model of automobile according to the invention.
Figure 12B:
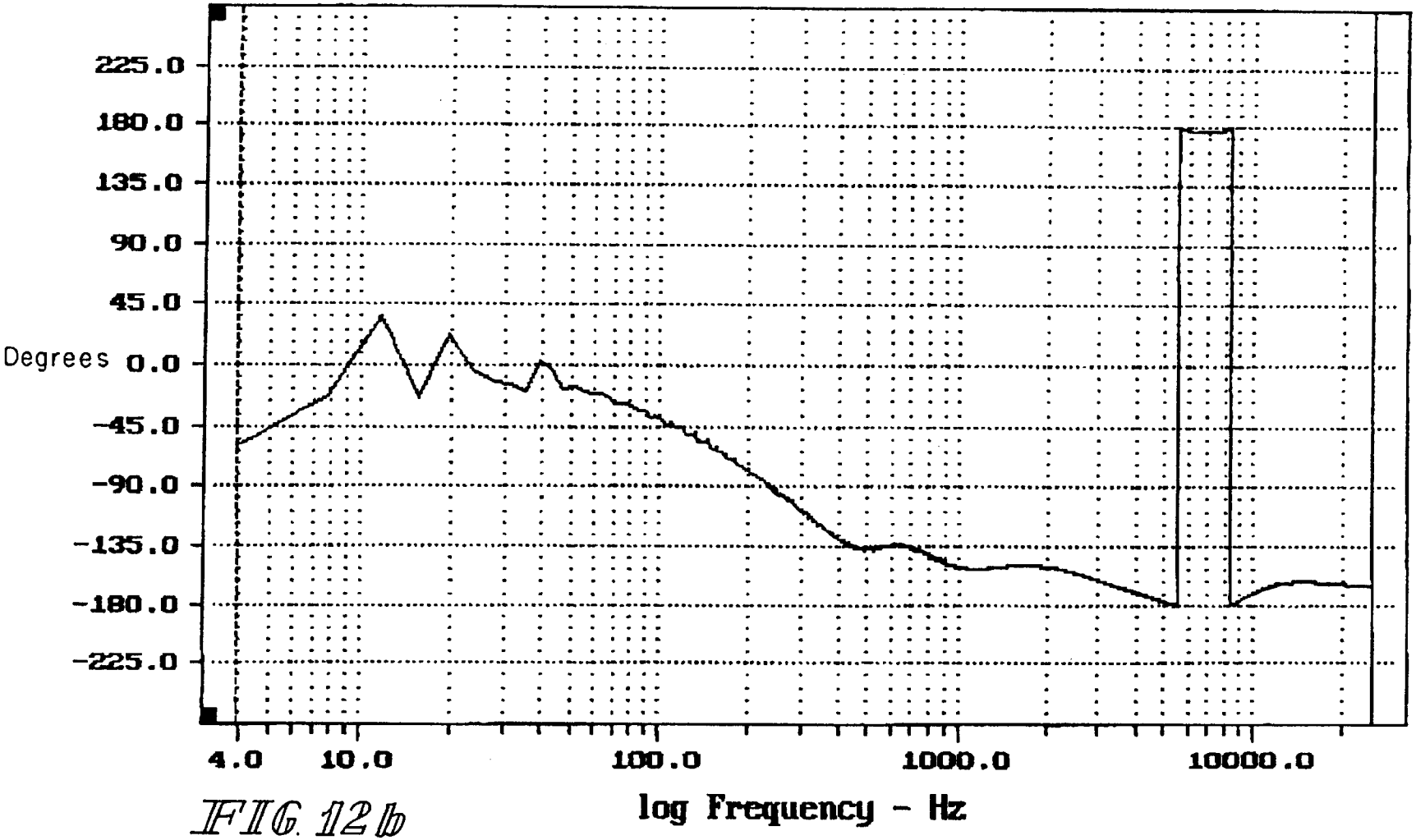

FIG. 12*a* illustrates the magnitude of a suitable transfer function of equalizer 100 for the above identified vehicle in dB versus the logarithm of frequency. FIG. 12*b* illustrates the phase of a suitable transfer function of equalizer 100 for the above identified vehicle in degrees versus the logarithm of frequency.

Figure 13A:
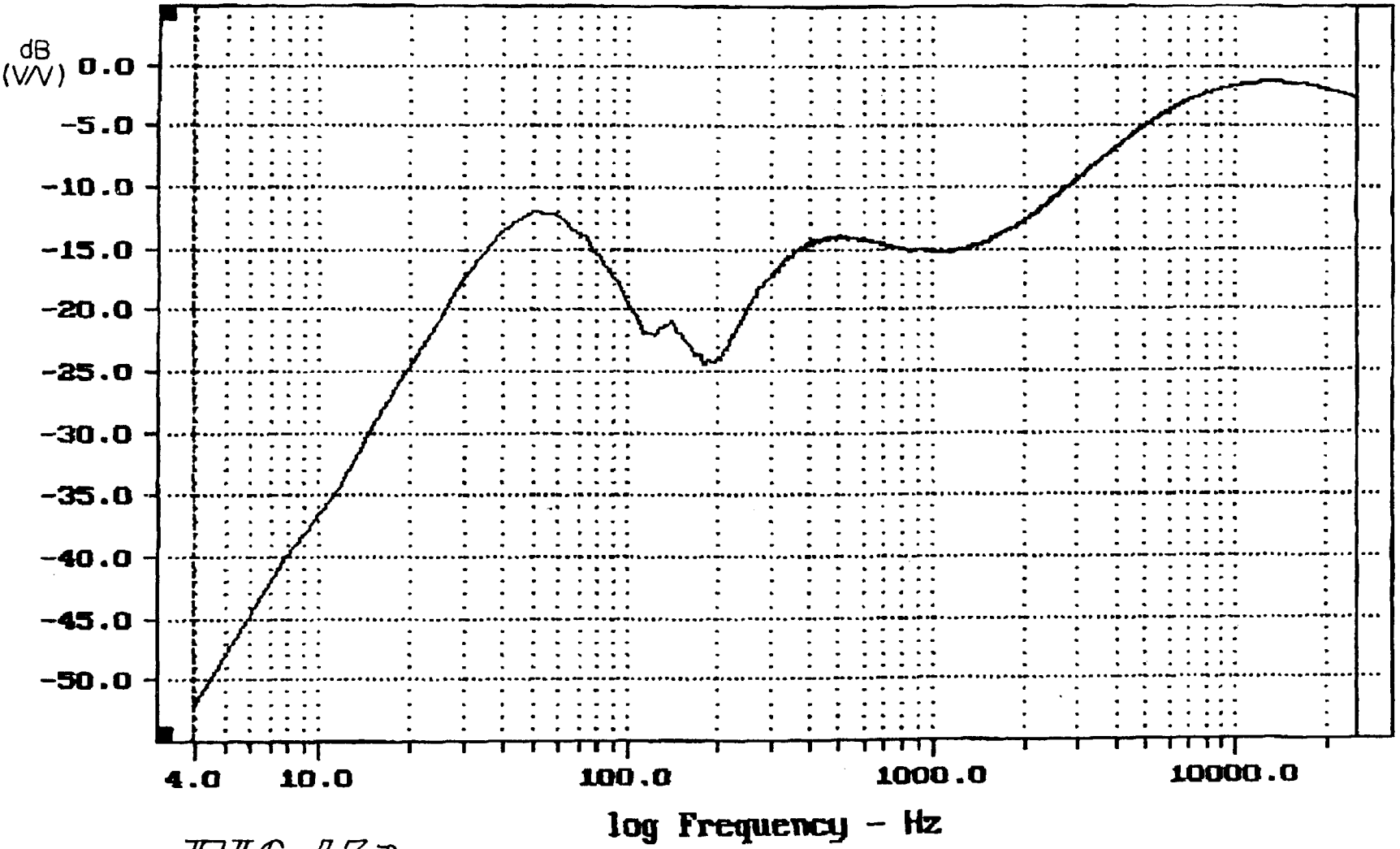
FIGS. 13*a–b* illustrate a transfer function of an equalization and filtering channel for a particular make and model of automobile according to the invention; and, FIGS. 14*a–b* illustrate a transfer function of an equalization and filtering channel for a particular make and model of automobile according to the invention.
Figure 13B:
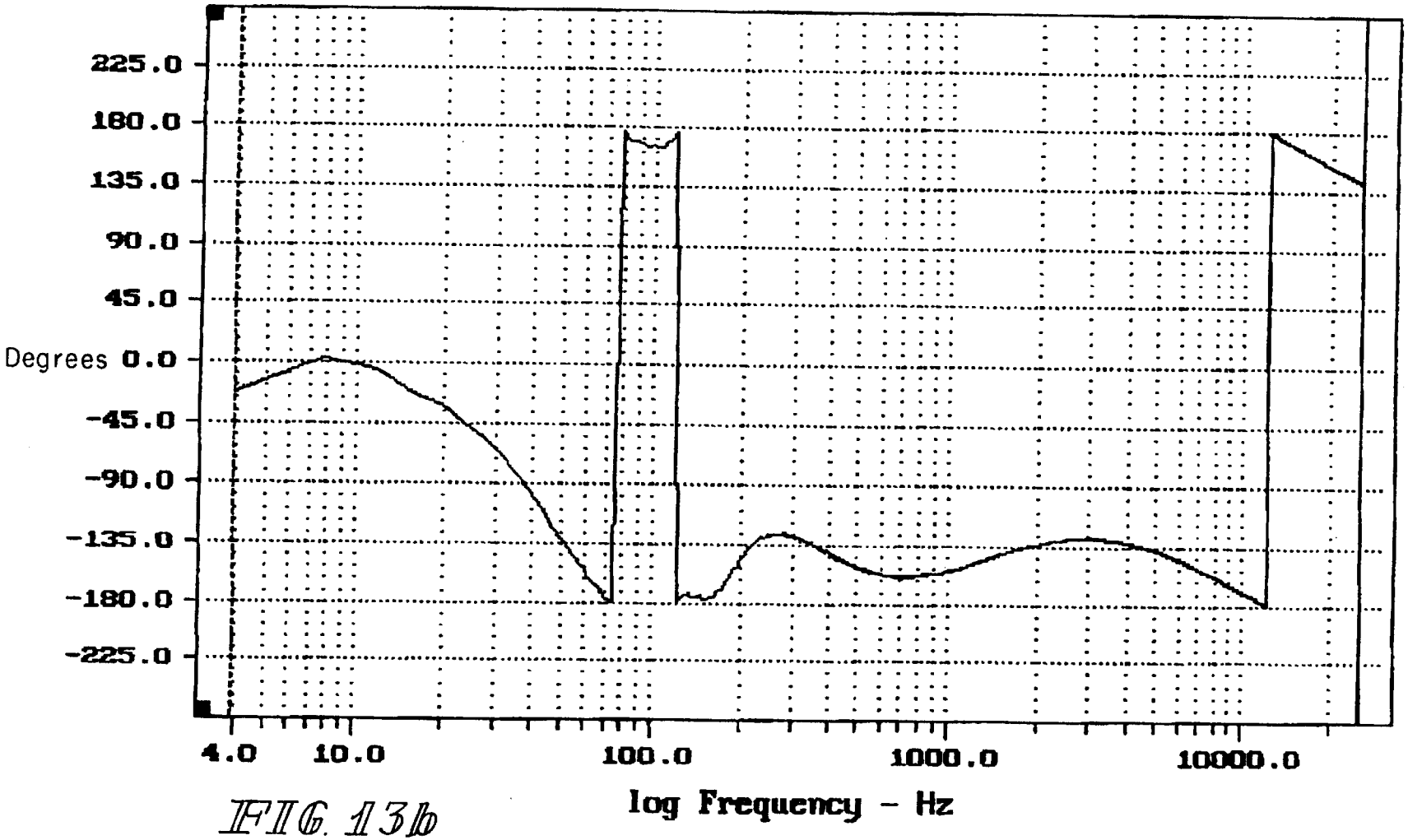
Figure 9H:
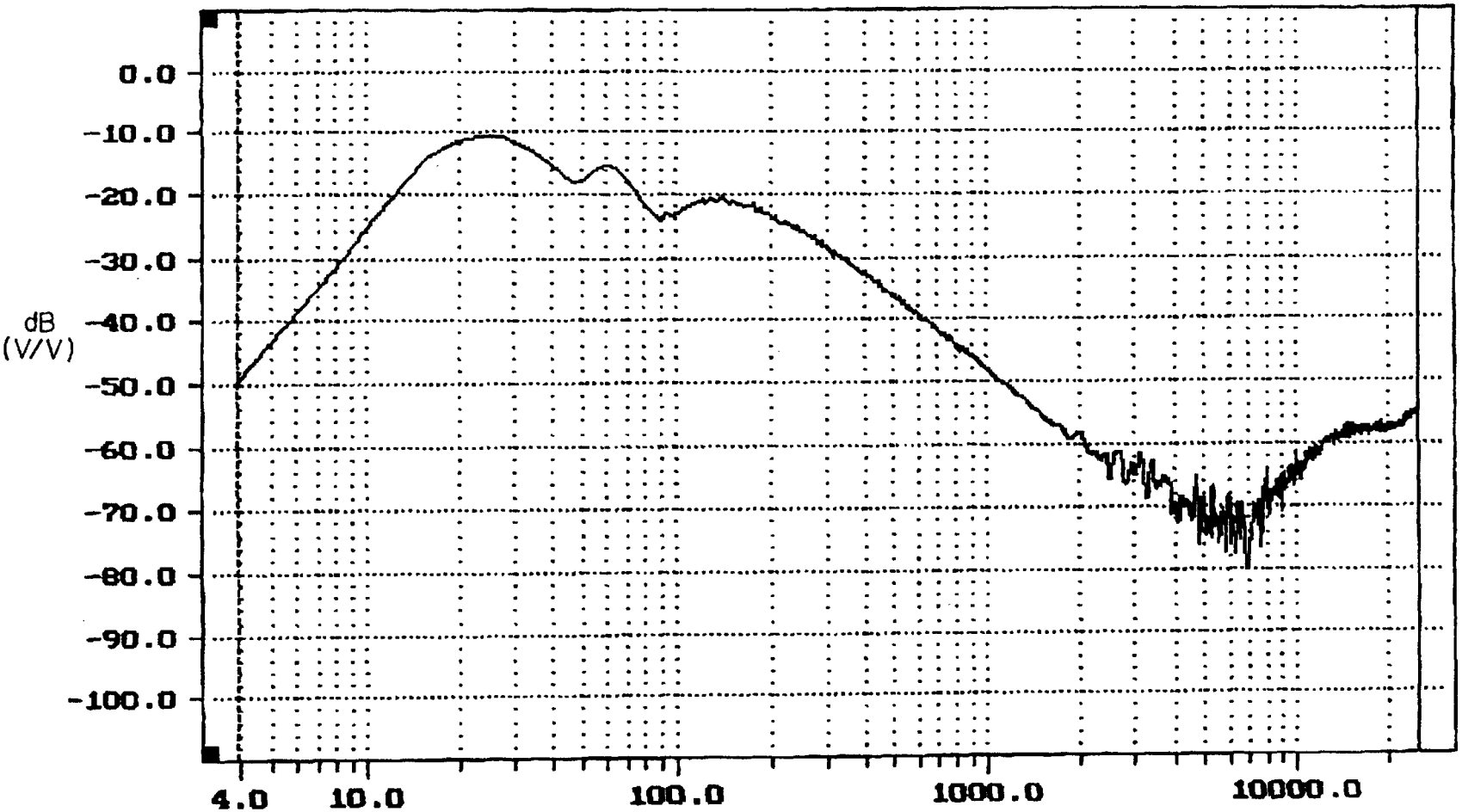

FIG. 13*a* illustrates the magnitude of a suitable transfer function of equalizer 112 for the above identified vehicle in dB versus the logarithm of frequency. FIG. 13*b* illustrates the phase of a suitable transfer function of equalizer 112 for the above identified vehicle in degrees versus the logarithm of frequency.

Figure 14H:
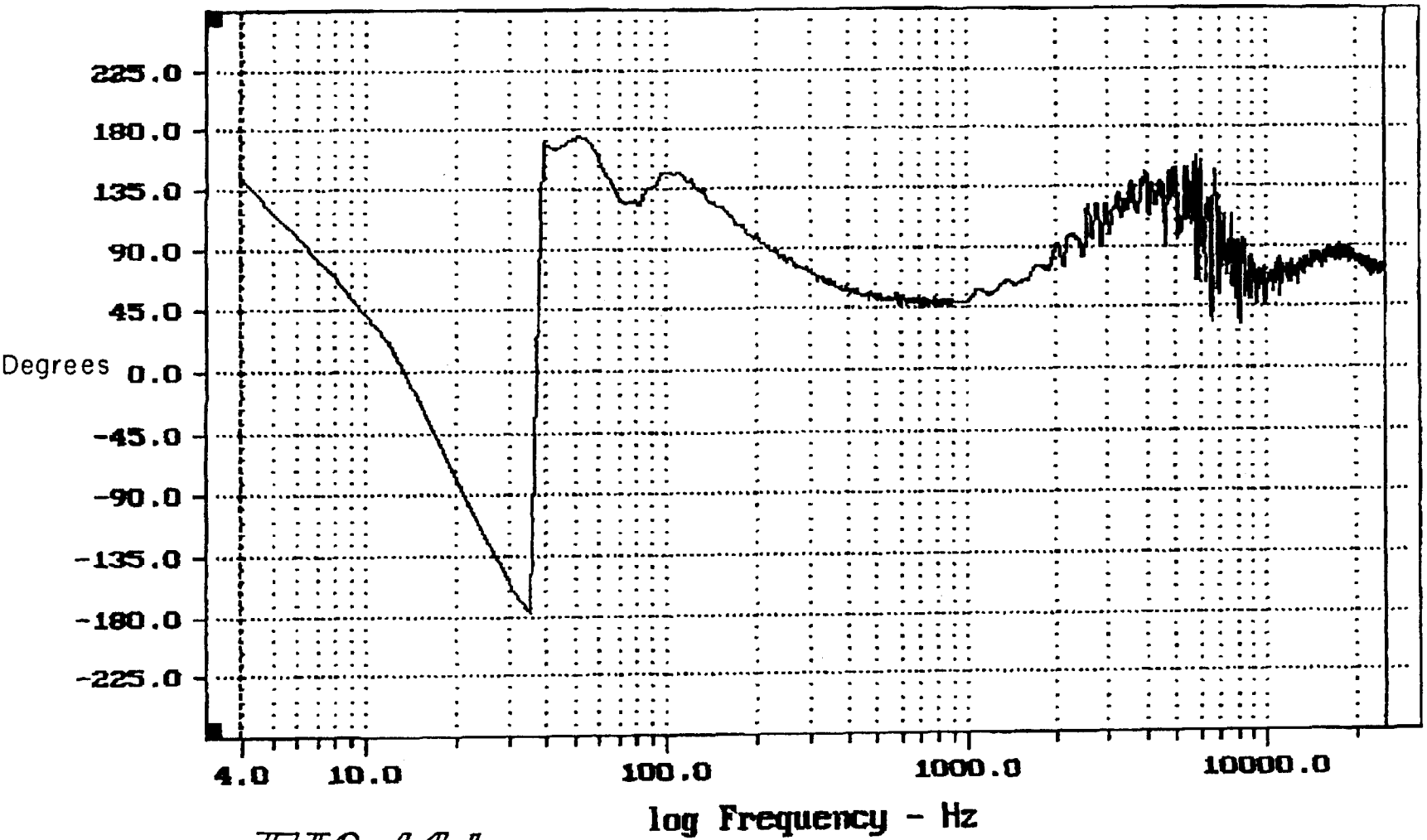

FIG. 14*a* illustrates the magnitude of a suitable transfer function of equalizer 126 for the above identified vehicle in dB versus the logarithm of frequency. FIG. 14*b* illustrates the phase of a suitable transfer function of equalizer 126 for the above identified vehicle in degrees versus the logarithm of frequency.

We claim:

1. A method of synthesizing a set of filters comprising the steps of locating first and second loudspeakers at first and second locations, respectively, coupling a first component of an audio program to the first loudspeaker to be reproduced thereby, coupling a second component of the audio program to the second loudspeaker to be reproduced thereby, placing first and second microphones at third and fourth locations, respectively, at which the reproduced first and second audio components are to be heard in order to convert audio impinging upon the first and second microphones into first and second microphone signals, respectively, developing from the first and second components of the audio program and the first and second microphone signals a first set of transfer functions, locating one of the first and second loudspeakers at a fifth location, different from at least one of the first and second locations, at which it is desired to create an image of the one of the first and second loudspeakers, coupling the first component to the first loudspeaker to be reproduced thereby, coupling the second component to the second loudspeaker to be reproduced thereby, developing from the first and second components impinging on the first and second microphones, third and fourth microphone signals, respectively, developing from the first and second components and the third and fourth microphone signals, respectively, a second set of transfer functions, and synthesizing the set of filters from the first and second sets of transfer functions.

2. The method of claim 1 wherein locating the first and second loudspeakers at first and second locations, respectively, and placing first and second microphones at third and fourth locations, respectively, together comprise locating the first and second loudspeakers at first and second locations, respectively, which are non-symmetric with respect to the third and fourth locations, respectively.

3. The method of claim 1 wherein placing first and second microphones at third and fourth locations, respectively, comprises providing a dummy head and providing the first and second microphones at about the locations of the left and right pinnae, respectively, of the dummy head.

4. The method of claim 1 wherein locating one of the first and second loudspeakers at a fifth location comprises locating the first and second loudspeakers at fifth and sixth locations, respectively, at which it is desired to create images of the first and second loudspeakers, respectively, the fifth and sixth locations being different from both the first and second locations.

5. The method of claim 1 wherein developing a first set of transfer functions and developing a second set of transfer functions together comprise first developing the first set of transfer functions and subsequently developing the second set of transfer functions.

6. The method of claim 1 wherein developing a first set of transfer functions and developing a second set of transfer functions together comprise first developing the second set of transfer functions and subsequently developing the first set of transfer functions.

7. The method of claim 1, 2, 3, 4, 5 or 6 wherein locating first and second loudspeakers at first and second locations comprises locating first and second loudspeakers at first and second locations, respectively, within a vehicle passenger compartment.

8. The method of claim 7 wherein locating one of the first and second loudspeakers at a fifth location comprises locating the one of the first and second loudspeakers at a fifth location outside the vehicle passenger compartment.

9. The method of claim 8 wherein locating one of the first and second loudspeakers at fifth location comprises locating the first and second loudspeakers at fifth and sixth locations, respectively, outside the vehicle passenger compartment.

10. A set of filters synthesized by the method of claim 1.

11. A set of filters synthesized by the method of claim 2.

12. A set of filters synthesized by the method of claim 3.

13. A set of filters synthesized by the method of claim 4.

14. A set of filters synthesized by the method of claim 5.

15. A set of filters synthesized by the method of claim 6.

16. A set of filters synthesized by the method of claim 7.

17. A set of filters synthesized by the method of claim 8.

18. A set of filters synthesized by the method of claim 9.

19. A sound reproduction system incorporating a set of filters synthesized by the method of claim 1.

20. A sound reproduction system incorporating a set of filters synthesized by the method of claim 2.

21. A sound reproduction system incorporating a set of filters synthesized by the method of claim 3.

22. A sound reproduction system incorporating a set of filters synthesized by the method of claim 4.

23. A sound reproduction system incorporating a set of filters synthesized by the method of claim 5.

24. A sound reproduction system incorporating a set of filters synthesized by the method of claim 6.

25. A sound reproduction system incorporating a set of filters synthesized by the method of claim 7.

26. A sound reproduction system incorporating a set of filters synthesized by the method of claim 8.

27. A sound reproduction system incorporating a set of filters synthesized by the method of claim 9.

* * * * *